US005238790A

United States Patent [19]

Shimura et al.

[11] Patent Number: 5,238,790

[45] Date of Patent: Aug. 24, 1993

[54] SILVER HALIDE PHOTOGRAPHIC LIGHT-SENSITIVE MATERIAL AND METHOD OF PROCESSING THE SAME

[75] Inventors: Yoshio Shimura; Hidetoshi Kobayashi; Hideaki Naruse, all of Minami-Ashigara, Japan

[73] Assignee: Fuji Photo Film Co., Ltd., Kanagawa, Japan

[21] Appl. No.: 810,153

[22] Filed: Dec. 19, 1991

[30] Foreign Application Priority Data

Dec. 21, 1990 [JP] Japan ..... 2-404895

[51] Int. Cl.[5] ..... G03C 7/32; G03C 1/04; G03C 1/06

[52] U.S. Cl. ..... 430/377; 430/222; 430/434; 430/546; 430/634

[58] Field of Search ..... 430/222, 546, 634, 203, 430/551, 377, 434, 517, 566

[56] References Cited

U.S. PATENT DOCUMENTS 5,082,764 1/1992 Takahashi ..... 430/546

*Primary Examiner*—Richard L. Schilling
*Attorney, Agent, or Firm*—Sughrue, Mion, Zinn, Macpeak & Seas

[57] ABSTRACT

A silver halide photographic light-sensitive material contains a dispersion in which at least one compound represented by formula (I) below and a photographic useful reagent, which is hard to solve in water, are dispersed together. (In formula (I), $R_1$ and $R_2$ independently represent amino having 0 to 32 carbon atoms, alkoxy having 1 to 32 carbon atoms, or aryloxy having 6 to 32 carbon atoms, $R_3$ and $R_4$ independently represent a group which can be substituted on a benzene ring, and l and m independently represent an integer of 0 to 4. $R_3$ and/or $R_4$ may be the same or different when l and/or m is 2 to 4. In a method of processing a silver halide photographic light-sensitive material, the silver halide photographic light-sensitive material is exposed imagewise and then developed with a color developer not essentially containing benzyl alcohol.

Formula (I)

11 Claims, No Drawings

SILVER HALIDE PHOTOGRAPHIC LIGHT-SENSITIVE MATERIAL AND METHOD OF PROCESSING THE SAME

BACKGROUND OF THE INVENTION

1. Field of the Invention

The present invention relates to a silver halide photographic light-sensitive material and, more particularly, to a silver halide photographic light-sensitive material in which photographic useful agents, which are hard to solve in water, are added to hydrophilic organic colloid layers by dispersion using alkylamides, alkylesters, or arylesters of diphenic acid (biphenyl-2,2'-dicarboxylic acid).

2. Description of the Related Art

Conventionally, photographic useful reagents {e.g., oil-soluble couplers, antioxidants (e.g., alkylhydroquinones, alkylphenols, chromans, and coumarones) for use in preventing discoloration, color fog, or color mixing, film hardeners, oil-soluble filter dyes, oil-soluble ultraviolet absorbents, oil-soluble fluorescent brighteners, DIR compounds (e.g., DIR hydroquinones and colorless DIR couplers), developing agents, dye developing agents, DDR redox compounds, and DDR couplers} are dissolved in appropriate oil-forming agents, i.e., high boiling point organic solvents, and added to hydrophilic organic colloid layers (e.g., light-sensitive emulsion layers, filter layers, back layers, antihalation layers, interlayers, and protective layers) while being dispersed in a solution of hydrophilic organic colloid, particularly gelatin in the presence of surfactants. General examples of the high boiling point organic solvent are a phthalic acid ester compound and a phosphoric acid ester compound.

The phthalic acid ester compound or the phosphoric acid ester compound as the high boiling point organic solvent has been widely used since the compound is excellent in affinity in a colloid layer such as a gelatin layer, in effects on stability and hue of a color dye image, and in chemical stability in a light-sensitive material, and is available at a low cost.

These well-known high boiling point organic solvents (e.g., the phthalic acid ester compound and the phosphoric acid ester compounds), however, are still unsatisfactory in an effect of preventing discoloration and stains of a color dye image, caused by light, heat, or humidity, for use in recent light-sensitive materials required to have high performance.

As described above, various requirements are imposed on high boiling point organic solvents to be used in recent light-sensitive materials. For example, a high boiling point organic solvent is required to be easily obtained or manufactured at a low cost, be excellent in solubility and dispersion stability in a photographic useful reagent, and have no influence on developing and photographic properties. In addition, a high boiling point organic solvent is required to be superior in safety and have no influence on environments, and be excellent in an effect of preventing discoloration of a dye image and in chemical stability.

Recently, development has been improved in terms of rapidity, ease, and a decreased replenisher amount (including washing water) and performed in a decentralized manner rather than a centralized one. Accordingly, a problem of reduction discoloration at the time of bleaching or bleach-fixing of a cyan dye has become of major interest. It is assumed that this problem is caused because when a developing agent is carried over to a bleaching or bleach-fixing bath, an iron (III) ion complex in the bleaching or bleach-fixing bath is reduced to an iron (II) ion complex, or an iron (II) ion complex increased by fatigue in the bleaching or bleach-fixing bath reduces a cyan dye to a colorless leuco dye. Therefore, in addition to the various requirements described above, a high boiling point organic solvent is required to have an effect of suppressing reduction discoloration of a cyan dye. JP-A-62-134642 ("JP-A" means Unexamined Published Japanese Patent Application) discloses, e.g., phthalic acid ester having a bulky substituent at its ortho position, and European Patent (EP) 228,064A2 discloses, e.g., phthalic acid ester of tertiary alcohol. Each patent states an effect of suppressing reduction discoloration of a cyan dye caused by iron (II) ions and an effect of preventing discoloration and stains in a dye image caused by light, heat, or humidity.

The compounds described in these patents have an effect of preventing discoloration and stains in a dye image caused by light, heat, or humidity. However, they deteriorate the color forming properties of couplers or have no satisfactory effect of suppressing reduction discoloration of a cyan dye caused by iron (II) ions.

Recent photographic light-sensitive materials are required to have higher sensitivity, higher image quality, and higher storage stability of a color image more eagerly than before.

A strong demand, therefore, has arisen for development of a high boiling point organic solvent which does not deteriorate the color forming properties of couplers, has high storage stability of a color image, and is excellent in an effect of suppressing reduction discoloration of a cyan dye caused by iron (II) ions.

It is, however, difficult for conventional high boiling point organic solvents, including those in the two above-mentioned patents, to satisfy all these requirements.

Conventionally, benzyl alcohol has been used as a color booster in color developers for silver halide photographic light-sensitive materials. However, taking into account a recent tendency of environmental protection, color developers not essentially containing benzyl alcohol have become mainly used in order to reduce an environmental pollution load of waste liquors.

SUMMARY OF THE INVENTION

It is, therefore, the first object of the present invention to provide a silver halide photographic light-sensitive material using a high boiling point organic solvent which does not deteriorate the color forming properties of couplers and is excellent in an effect of suppressing discoloration (particularly, discoloration of a yellow dye image against light and discoloration of a cyan dye image caused by heat) or stains (contamination on a white background) of a color image caused by heat, light, or humidity, and a method of processing the same.

It is the second object of the present invention to provide a silver halide photographic light-sensitive material in which reduction discoloration of a cyan dye caused by iron (II) ions is significantly suppressed, and a method of processing the same.

It is the third object of the present invention to provide a silver halide photographic light-sensitive material using a high boiling point organic solvents excellent in dissolving and stably dispersing a photographic useful reagent, and a method of processing the same.

The above objects of the present invention are achieved by, following (1) a silver halide photographic light-sensitive material, and (2) a method of processing the same.

(1) A silver halide photographic light-sensitive material containing a dispersion in which at least one compound represented by formula (I) shown in Table A and a photographically useful reagent, which is hard to dissolve in water, are dispersed together, in formula (I) $R_1$ and $R_2$ independently represents amino having 0 to 32 carbon atoms, alkoxy having 1 to 32 carbon atoms, or aryloxy having 6 to 32 carbon atoms, $R_3$ and $R_4$ independently represents a group which can be substituted on a benzene ring, and l and m independently represents an integer of 0 to 4, $R_3$ and/or $R_4$ being able to be the same or different when l and/or m is 2 to 4.

(2) A method of processing a silver halide photographic light-sensitive material described in item (1) above, wherein the silver halide photographic light-sensitive material is exposed imagewise and then developed with a color developer not essentially containing benzyl alcohol.

DETAILED DESCRIPTION OF THE INVENTION

The present invention will be described in greater detail below.

A compound represented by formula (I) of the present invention can be considered to be aromatic carboxylic acid ester of alcohols and phenols and aromatic carboxylic acid amide of amines, and several analogous compounds are known. For example, JP-A-54-31728 and JP-A-62-283329 disclose, e.g., cycloalkylester of phthalic acid and tertiary alcoholester of phthalic acid, respectively, and state an effect of preventing discoloration and stains in a dye image caused by light, heat, or humidity. JP-A-62-134642 discloses, e.g., arylester of phthalic acid and states an effect of preventing discoloration and stains in a dye image caused by light, heat, or humidity and an effect of suppressing reduction discoloration of a cyan dye caused by iron (II) ions. However, the compounds described in these patents are esters of phthalic acid and therefore different from amides, alkylesters, and arylesters of diphenic acid (biphenyl-2,2'-dicarboxylic acid) of the present invention. In addition, though the compounds described in the above patents have an effect of preventing discoloration and stains in a dye image caused by light, heat, or humidity, this effect is weak. In another case, the compounds deteriorate the color forming properties of couplers or have only an insignificant effect of suppressing reduction discoloration of a cyan dye caused by iron (II) ions. That is, each compound is poor in any one of these points. This fact will be cleared in embodiments to be described later.

A compound represented by formula (I) will be described in detail below.

In formula (I), $R_1$ and $R_2$ independently represent amino having 0 to 32 carbon atoms, alkoxy having 1 to 32 carbon atoms, or aryloxy having 6 to 32 carbon atoms. When $R_1$ or $R_2$ represents amino, substituents to be bonded to nitrogen are two groups selected from alkyl, aryl, and a hydrogen atom, and the two groups may be the same or different. Examples of the substituent are methylamino, di-n-butylamino, anilino, and N-methylanilino. Main groups represented by $R_1$ and $R_2$ in formula (I) are represented by groups (I-1) to (I-5) below.

| | |
|---|---|
| Group (I-1) | $-NR_5R_6$ |
| Group (I-2) | $-N(R_7)(Ar_1)$ |
| Group (I-3) | $-N(Ar_2)(Ar_3)$ |
| Group (I-4) | $-O-R_8$ |
| Group (I-5) | $-O-Ar_4$ |

When a substituent in groups (I-1) to (I-5) is alkyl or a group including alkyl and not particularly defined, the alkyl may be either straight-chain, branched-chain, or cyclic, and means alkyl (e.g., methyl, isopropyl, t-butyl, cyclohexyl, 2-ethylhexyl, dodecyl, hexadecyl, allyl, and benzyl) which may be substituted or contain an unsaturated bond. The alkyl may have a substituent, and preferable examples of the substituent are a halogen atom, alkoxy, aryl, and aryloxy.

When a substituent in groups (I-1) to (I-5) is aryl or a group including aryl and not particularly defined, the aryl means monocyclic or condensed-ring aryl (e.g., phenyl, 1-naphthyl, p-tolyl, o-tolyl, 4-methoxyphenyl, 4-(1,1,3,3-tetramethyl)butylphenyl, 8-quinolyl, or 2,4-di-pentylphenyl) which may be substituted. Preferable examples of a substituent on the aryl are a halogen atom, alkyl, alkoxy, and aryloxy.

In group (I-1), $R_5$ and $R_6$ independently represent a hydrogen atom or alkyl having 1 to 32 carbon atoms, and they may be bonded to form a heterocyclic ring. $R_5$ and $R_6$ may be the same or different. Note that the total number of carbon atoms in $R_5$ and $R_6$ does not exceed 32.

In group (I-2), $R_7$ represents a hydrogen atom or alkyl having 1 to 26 carbon atoms, and $Ar_1$ represents aryl having 6 to 32 carbon atoms. Note that the total number of carbon atoms in $R_7$ and $Ar_1$ does not exceed 32.

In group (I-3), $Ar_2$ and $Ar_3$ independently represent aryl having 6 to 26 carbon atoms. Note that the total number of carbon atoms in $Ar_2$ and $Ar_3$ does not exceed 32.

In group (I-4), $R_8$ represents alkyl having 1 to 32 carbon atoms.

In group (I-5), $Ar_4$ represents aryl having 6 to 32 carbon atoms.

In formula (I), $R_3$ and $R_4$ independently represent a group which can be substituted on a benzene ring, and l and m independently represent an integer of 0 to 4.

When l and/or m is 2 to 4, $R_3$ and/or $R_4$ may be the same or different. Examples of $R_3$ and $R_4$ are alkyl (e.g., methyl, ethyl, isopropyl, sec-butyl, isobutyl, t-butyl, cyclopentyl, t-pentyl, cyclohexyl, t-hexyl, 2-ethylhexyl, 2-decyl, dodecyl, benzyl, trifluoromethyl, or chloroethyl), alkenyl (e.g., vinyl, allyl, 2-methylallyl, cyclohexenyl, undecenyl, dodecenyl, or oleyl), aryl (e.g., phenyl or p-tolyl), alkoxy (e.g., methoxy, ethoxy, butoxy, methoxyethoxy, benzyloxy, dodecyloxy, or cyclohexyloxy), aryloxy (e.g., phenoxy, 2-phenylphenoxy, 4-methoxyphenoxy, 3-chlorophenoxy, or 1-naphthoxy), carbonamido (e.g., acetoamido, trifluoroacetoamido, or benzamido), sulfonamido (e.g., methanesulfonamido or toluenesulfonamido), acyloxy (e.g., acetoxy or benzoyloxy), sulfonyl (e.g., methylsulfonyl, phenylsulfonyl, or p-tolylsulfonyl), hydroxyl, and a halogen atom (fluorine, chlorine, bromine, or iodine).

In a compound represented by formula (I), $R_1$ and $R_2$ preferably, independently represent a group which has amino having 1 to 24 carbon atoms, alkoxy having 1 to 24 carbon atoms, or aryl having 6 to 22 carbon atoms and is mainly represented by group (I-1), (I-2), (I-4), or (I-5), and more preferably a group which has an amino having an aryl having 6 to 16 carbon atoms and is mainly represented by group (I-1), (I-4), or (I-5).

In formula (I), $R_3$ and $R_4$ preferably, independently represent a halogen atom (fluorine, chlorine, bromine, or iodine), alkyl, alkoxy, aryloxy, or aryl, and more preferably a halogen atom, alkyl, or alkoxy.

In formula (I), l and m preferably, independently represent an integer of 0 or 1, and more preferably 0.

Examples of $R_1$ and $R_2$ will be listed in Table B to be presented later.

In formula (I), when l and m each represent 0 or 1, $R_1$ and $R_2$ each preferably represent amino having 1 to 24 carbon atoms or alkoxy having 1 to 24 carbon atoms. It is also preferable that in formula (I), when l and m each represent 0 or 1, $R_1$ and $R_2$ each represent aryl having 6 to 16 carbon atoms, alkoxy or aryloxy.

In formula (1), when l and m represent 0, $R_1$ and $R_2$ each preferably represent amino having 1 to 24 carbon atoms or alkoxy having 1 to 24 carbon atoms. It is also preferable that in formula (I), when l and m represent 0, $R_1$ and $R_2$ each represent aryl having 6 to 16 carbon atoms, alkoxy or aryloxy.

Examples of a compound represented by formula (I) used in the present invention are shown in Table 1 below, but the present invention is not limited to these examples. In Table 1, each of X, Y, 2 to 5, and 2' to 5' described in the column of "Position of substituent" represents a position of carbon in a biphenyl compound as shown in formula (I-A) of Table A (to be presented later).

TABLE 1

| Compound No. | Position of substituent | Type of substituent |
|---|---|---|
| 1 | X | —CONHCH$_3$ |
| | Y | " |
| 2 | X | —CONHC$_2$H$_5$ |
| | Y | " |
| 3 | X | —CONHC$_3$H$_7$ |
| | Y | " |
| 4 | X | —CONHC$_4$H$_9$ |
| | Y | " |
| 5 | X | —CONHC$_6$H$_{13}$ |
| | Y | " |
| 6 | X | —CONHC$_8$H$_{17}$ |
| | Y | " |
| 7 | X | —CONHCH$_2$CH(C$_2$H$_5$)(C$_4$H$_9$) |
| | Y | " |
| 8 | X | —CONHC$_{10}$H$_{21}$ |
| | Y | " |
| 9 | X | —CONHC$_{16}$H$_{33}$ |
| | Y | " |
| 10 | X | —CONHCH$_2$CH$_2$CH$_2$OC$_{12}$H$_{25}$ |
| | Y | " |
| 11 | X | $X_{11}$ described in TABLE C (to be presented later) |
| | Y | $X_{11}$ described in TABLE C (to be presented later) |
| 12 | X | CONHCH$_2$CH(CH$_3$)$_2$ |
| | Y | " |
| 13 | X | —CON(CH$_3$)$_2$ |
| | Y | " |
| 14 | X | —CON(C$_2$H$_5$)$_2$ |
| | Y | " |
| 15 | X | —CONH(C$_3$H$_7$)$_2$ |
| | Y | " |
| 16 | X | —CONH(C$_4$H$_9$)$_2$ |
| | Y | " |
| 17 | X | —CONH(CH(CH$_3$)$_2$)$_2$ |
| | Y | " |
| 18 | X | —CON(CH$_2$CH(CH$_3$)$_2$)$_2$ |

TABLE 1-continued

| Compound No. | Position of substituent | Type of substituent |
|---|---|---|
| | Y | " |
| 19 | X | —CON(C$_5$H$_{11}$)$_2$ |
| | Y | " |
| 20 | X | —CON(C$_6$H$_{13}$)$_2$ |
| | Y | " |
| 21 | X | —CON(C$_8$H$_{17}$)$_2$ |
| | Y | " |
| 22 | X | —CON(C$_{10}$H$_{21}$)$_2$ |
| | Y | " |
| 23 | X | —CON(CH$_2$CH(C$_2$H$_5$)(C$_4$H$_9$))$_2$ |
| | Y | " |
| 24 | X | —CONHPh |
| | Y | " |
| 25 | X | —CONCH$_3$Ph |
| | Y | " |
| 26 | X | —CONHCH$_2$CH(C$_2$H$_5$)(C$_4$H$_9$) |
| | Y | " |
| | 4 | —CH$_3$ |
| | 4' | " |
| 27 | X | —CONHC$_{16}$H$_{13}$ |
| | Y | " |
| | 4 | —OCH$_3$ |
| | 4' | " |
| 28 | X | —CON(C$_4$H$_9$)$_2$ |
| | Y | " |
| | 4 | —Cl |
| | 4' | " |
| 29 | X | —CONHCH$_2$CH(C$_2$H$_5$)(C$_4$H$_9$) |
| | Y | " |
| | 3 | —Cl |
| | 3' | —Cl |
| 30 | X | —COOCH$_3$ |
| | Y | " |
| 31 | X | —COOC$_2$H |
| | Y | " |
| 32 | X | —COOC$_3$H$_7$ |
| | Y | " |
| 33 | X | —COOCH(CH$_3$)$_2$ |
| | Y | " |
| 34 | X | —COOC$_4$H$_9$ |
| | Y | " |
| 35 | X | —COOCH$_2$CH(CH$_3$)$_2$ |
| | Y | " |
| 36 | X | —COOC(CH$_3$)$_3$ |
| | Y | " |
| 37 | X | —COOC$_6$H$_{13}$ |
| | Y | " |
| 38 | X | —COOC$_8$H$_{17}$ |
| | Y | " |
| 39 | X | —COOC$_{10}$H$_{21}$ |
| | Y | " |
| 40 | X | —COOC$_{14}$H$_{29}$ |
| | Y | " |
| 41 | X | —COOC$_{18}$H$_{37}$ |
| | Y | " |
| 42 | X | —COOCH$_2$CH(C$_2$H$_5$)(C$_4$H$_9$) |
| | Y | " |
| 43 | X | $X_{43}$ described in TABLE C (to be presented later) |
| | Y | $X_{43}$ described in TABLE C (to be presented later) |
| 44 | X | $X_{44}$ described in TABLE C (to be presented later) |
| | Y | $X_{44}$ described in TABLE C (to be presented later) |
| 45 | X | $X_{45}$ described in TABLE C (to be presented later) |
| | Y | $X_{45}$ described in TABLE C (to be presented later) |
| 46 | X | $X_{46}$ described in TABLE C (to be presented later) |
| | Y | $X_{46}$ described in TABLE C (to be presented later) |
| 47 | X | $X_{47}$ described in TABLE C (to be presented later) |
| | Y | $X_{47}$ described in TABLE C (to be presented later) |
| 48 | X | $X_{48}$ described in TABLE C (to be presented later) |
| | Y | $X_{48}$ described in TABLE C (to |

TABLE 1-continued

| Compound No. | Position of substituent | Type of substituent |
|---|---|---|
| | | be presented later) |
| | 3' | —Cl |
| 49 | X | —$COOCH_2CH(C_2H_5)(C_4H_9)$ |
| | Y | " |
| | 4 | —$C_2H_5$ |
| | 4' | " |
| 50 | X | $X_{50}$ described in TABLE C (to be presented later) |
| | Y | $X_{50}$ described in TABLE C (to be presented later) |
| | 4 | —$OCH_3$ |
| | 4' | " |
| 51 | X | $X_{51}$ described in TABLE C (to be presented later) |
| | Y | $X_{51}$ described in TABLE C (to be presented later) |
| 52 | X | $X_{52}$ described in TABLE C (to be presented later) |
| | Y | $X_{52}$ described in TABLE C (to be presented later) |
| 53 | X | $X_{53}$ described in TABLE C (to be presented later) |
| | Y | $X_{53}$ described in TABLE C (to be presented later) |
| 54 | X | $X_{54}$ described in TABLE C (to be presented later) |
| | Y | $X_{54}$ described in TABLE C (to be presented later) |
| 55 | X | $X_{55}$ described in TABLE C (to be presented later) |
| | Y | $X_{55}$ described in TABLE C (to be presented later) |
| 56 | X | $X_{56}$ described in TABLE C (to be presented later |
| | Y | $X_{56}$ described in TABLE C (to be presented later |
| | 4 | —$C_2H_5$ |
| | 4' | " |
| 57 | X | $X_{57}$ described in TABLE C (to be presented later) |
| | Y | $X_{57}$ described in TABLE C (to be presented later |
| 58 | X | $X_{58}$ described in TABLE C (to be presented later) |
| | Y | $X_{58}$ described in TABLE C (to be presented later) |
| 59 | X | $X_{59}$ described in TABLE C (to be presented later) |
| | Y | $X_{59}$ described in TABLE C (to be presented later) |
| 60 | X | $X_{60}$ described in TABLE C (to be presented later) |
| | Y | $X_{60}$ described in TABLE C (to be presented later) |

A compound represented by formula (I) can be synthesized by a condensation reaction between alcohols, phenols, arylamines, or alkylamines and diphenic acid or diphenic acid chloride. Of these compounds, diphenic acid chloride is most generally used. Commonly, diphenic acid chloride can be obtained by reacting diphenic acid using, e.g., thionyl chloride or oxalyl chloride in either the absence or presence of a solvent such as methylene chloride, chloroform, carbon tetrachloride, dichloroethane, toluene, N,N-dimethylformamide, or N,N-dimethylacetoamide. The reaction temperature is commonly −20° C. to 150° C., and preferably −10° C. to 80° C. A base (e.g., sodium carbonate, potassium carbonate, pyridine, tetramethylguanidine, or triethylamine) is commonly used in the condensation reaction between alcohols, phenols, or amines and diphenic acid chloride. General examples of the solvent are benzene, toluene, methylene chloride, chloroform, dichloroethane, acetonitrile, tetrahydrofuran, dioxane, N,N-dimethylformamide, and N,N-dimethylacetoamide.

Note that diphenic acids are synthesized by vapor phase oxidation or oxidation by potassium dichromate-sulfuric acid or peracetic acid of phenanthrolines. Diphenic acid esters can also be synthesized by Ullmann reaction of o-halogeno benzoic acid esters. Examples of synthesis will be described below.

SYNTHESIS EXAMPLE 1

Synthesis of diphenic acid chloride (biphenyl-2,2'-dicarbonylchloride)

24.2 g of diphenic acid (biphenyl-2,2'-dicarboxylic acid) were dissolved in 200 ml of methylene chloride and 1 ml of N,N-dimethylformamide, and 27.9 g of oxalylchloride were dropped in the resultant solution under stirring at room temperature over 30 minutes. After the dropping, the resultant solution was reacted at room temperature for one hour, and the reaction solution was thickened in aspirator vacuum. Methylene chloride and an excessive amount of oxalylchloride were removed from the thickened solution to obtain an oily matter of diphenic acid chloride.

SYNTHESIS EXAMPLE 2

Synthesis of exemplified compound (16)

28 g of diphenic acid chloride were dissolved in 50 ml of acetonitrile, and the resultant solution was dropped under ice cooling in a mixture of 52 g of di-n-butylamine and 200 ml of acetonitrile. After the dropping, the resultant solution was reacted under ice cooling for 30 minutes and then at room temperature for one hour. 300 ml of ethyl acetate were added to the reaction solution, and the obtained ethyl acetate layer was washed with 300 ml of water three times. The ethyl acetate layer was dried with anhydrous sodium sulfate and thickened. The residue was crystallized by adding n-hexane and ethyl acetate, thus obtaining 37.8 g of an exemplified compound 16. The yield was 81.3%. The melting point of this compound was 98° C. to 99° C. Note that the structure of the compound was determined in accordance with $^1$HNMR spectrum, MASS spectrum, and elementary analysis (this applies similarly to the following examples).

SYNTHETIC EXAMPLE 3

Synthesis of exemplified compound (43)

28 g of diphenic acid chloride were dissolved in 50 ml of acetonitrile, and the resultant solution was dropped under ice cooling in a mixture of 20 g of cyclohexanol, 20 ml of pyridine, and 200 ml of acetonitrile. After the dropping, the resultant solution was reacted under ice cooling for 30 minutes and then at room temperature for one hour. 300 ml of ethyl acetate were added to the reaction solution, and the obtained ethyl acetate layer was washed with 300 ml of water three times. The ethyl acetate layer was dried with anhydrous sodium sulfate and thickened. The residue was crystallized by adding methanol, thereby obtaining 35.3 g of an exemplified compound 43. The yield was 87%. The melting point of this compound was 58° C. to 60° C. Following the same procedures as described above, an exemplified compound (51) (melting point = 76° C. to 77° C), an exemplified compound (44) (melting point = 141° C. to 142° C.), an exemplified compound (7) (oily matter), and a mixture (oily matter) of exemplified compounds (45), (46), and (47)
were prepared.

SYNTHESIS EXAMPLE 4

Synthesis of exemplified compound (42)

500 ml of toluene were added to 48.4 g of diphenic acid, 54.7 g of 2-ethylhexanol, and 7.6 g of p-toluenesulfonic acid, and the resultant solution was heated under reflux for five hours while water was removed by a water separator. After being cooled, the reaction solution was washed with water twice, dried with salt cake, and distilled off in toluene vacuum. The residue was purified with an ethyl acetate/n-hexane solvent mixture, as a developing solvent, using a chromatographic column filled with silica gel, thus obtaining 69 g of an oily exemplified compound 42 of interest.

A compound represented by formula (I) mainly functions as a high boiling point organic solvent. In this case, the high boiling point means a boiling point of 175° C. or more at normal pressures. The use amount of a compound represented by formula (I) is not particularly limited and can be changed in accordance with the application. Commonly, the amount was 0.1 to 4, and preferably 0.1 to 1.5 in weight ratio with respect to a photographic useful reagent.

The use amount of a dispersion consisting of a compound represented by formula (I) of the present invention and a photographically useful reagent with respect to a dispersion medium is, in weight ratio, 2 to 0.1, and preferably 1.0 to 0.2 with respect to 1 of the dispersion medium. In this case, a representative example of the dispersion medium is gelatin, and a hydrophilic polymer such as polyvinyl alcohol can also be exemplified. The dispersion of the present invention can contain various compounds, in addition to the compound of the present invention and the photographic useful reagent, in accordance with the application.

The dispersion of the present invention can be added to silver halide emulsion layers or non-light-sensitive layers such as protective layers, interlayers, and antihalation layers.

A compound represented by formula (I) of the present invention can be used in combination with conventionally known high boiling point organic solvents. When these known high boiling point organic solvents are used, the compound of the present invention is used preferably 50% or more, and more preferably 80% or more, in weight ratio, with respect to the total amount of the high boiling point organic solvents.

Examples of the high boiling point organic solvents which can be used in combination with the compound of the present invention are described in, e.g., U.S. Pat. No. 2,322,027. Examples of a high boiling point organic solvent having a boiling point of 175° C. or more at normal pressures are phthalic acid esters (e.g., dibutylphthalate, dicyclohexylphthalate, di-2-ethylhexylphthalate, decylphthalate, bis(2,4-di-t-amylphenyl)phthalate, bis(2,4-di-t-amylphenyl)isophthalate, and bis(1,1-diethylpropyl)phthalate), esters of phosphoric acid or phosphonic acid (e.g., triphenylphosphate, tricresylphosphate, 2-ethylhexyldiphenylphthalate, tricyclohexylphosphate, tri-2-ethylhexylphosphate, tridodecylphosphate, tributoxyethylphosphate, trichloropropylphosphate, and di-2-ethylhexylphenylphosphonate), benzoic acid esters (e.g., 2-ethylhexylbenzoate, dodecylbenzoate, and 2-ethylhexyl-p-hydroxybenzoate), amides (e.g., N,N-diethyldodecaneamide, N,N-diethylaurylamide, and N-tetradecylpyrrolidone), alcohols or phenols (e.g., isostearylalcohol and 2,4-di-tert-amylphenol), aliphatic carboxylic acid esters (e.g., bis(2-ethylhexyl)sebacate, dioctylazelate, glyceroltributylate, isostearyllactate, and trioctylcitrate), an aniline derivative (N,N-dibutyl-2-butoxy-5-tert-octylaniline), and hydrocarbons (e.g., paraffine, dodecylbenzene, and diisopropylnaphthalene). As a co-solvent, it is possible to use an organic solvent having a boiling point of about 30° C. or more, and preferably 50° C. to about 160° C. Typical examples of the solvent are ethyl acetate, butyl acetate, ethyl propionate, methylethylketone, cyclohexanone, 2-ethoxyethylacetate, and dimethylformamide.

Examples of the photographically useful reagent usable in the present invention are an oil-soluble coupler, an antioxidant (e.g., alkylhydroquinones, alkylphenols, chromans, and coumarones) for use in preventing discoloration, color fog, or color mixing, a film hardener, an oil-soluble filter dye, an oil-soluble ultraviolet absorbent, an oil-soluble fluorescent brightener, a DIR compound (e.g., DIR hydroquinones and colorless DIR couplers), a developing agent, a dye developing agent, a DDR redox compound, and a DDR coupler.

Of yellow couplers which can be used in the present invention or can be used together with the compound of the present invention, preferable examples are represented by formula (Y) described in Table A (to be presented later).

In formula (Y), $R_1$ represents aryl or tertiary alkyl, $R_2$ represents a hydrogen atom, a halogen atom (F, Cl, Br, or I), alkoxy, alkyl, amino, or aryloxy, $R_3$ represents a group which can be substituted on a benzene ring, X represents a hydrogen atom or a group (to be referred to as a split-off group hereinafter) which can split off by a coupling reaction with an oxidized form of an aromatic primary amine developing agent, and l represents an integer of 0 to 4. When l is two or more, $R_3$ may be the same or different.

$R_1$ is preferably aryl having 6 to 32 (preferably 6 to 18) carbon atoms or tertiary alkyl which may contain a cyclic structure having 4 to 32 (preferably 4 to 18) carbon atoms. These groups may be substituted by a substituent (e.g., a halogen atom, alkoxy, alkyl, acyl, alkoxycarbonyl, carbonamido, sulfonamido, aryl, aryloxy, alkylthio, or arylthio). Examples of $R_1$ are phenyl, o-tolyl, 4-methoxyphenoxy, 2-methoxyphenoxy, 4-sec-butoxyphenyl, t-butyl, t-pentyl, adamantyl, 1-methylcyclopropyl, 1-ethylcyclopropyl, 1-methylcyclobutyl, and 1-methylcyclopentyl.

$R_2$ is preferably a halogen atom (most preferably F or Cl), alkyl having 1 to 4 carbon atoms (e.g., methyl, ethyl, isopropyl, cyclopropyl, or t-butyl), alkoxy having 1 to carbon atoms (e.g., methoxy, butoxy, hexadecyloxy, methoxyethoxy, benzyloxy, or trifluoromethoxy), or aryloxy haivng 6 to 32 (preferably 6 to 18) carbon atoms (e.g., phenoxy or 4-methoxyphenoxy).

Examples of $R_3$ are a halogen atom, alkyl, aryl, alkoxy, aryloxy, alkoxycarbonyl, aryloxycarbonyl, carbonamide, sulfonamide, carbamoyl, sulfamoyl, alkylsulfonyl, ureido, sulfamoylamino, alkoxycarbonylamino, alkoxysulfonyl, acyloxy, nitro, a heterocyclic group, cyano, acyl, acyloxy, alkylsulfonyloxy, and arylsulfonyloxy. Preferable examples of $R_3$ are a halogen atom, cyano, alkoxy having 1 to 32 carbon atoms, aryloxy having 6 to 32 carbon atoms, alkoxycarbonyl having 2 to 32 carbon atoms, aryloxycarbonyl having 7 to 32 carbon atoms, carbonamide having 1 to 32 carbon atoms, and sulfonamide having 1 to 32 carbon atoms. When $R_3$ is substitutable, preferable examples of a substituent are a halogen atom, cyano, alkyl, aryloxy, alkoxycarbonyl, alkylthio, alkylsulfonyl, and arylsulfonyl.

In formula (Y), l preferably represents an integer of 1 or 2.

In formula (Y), examples of X are a heterocyclic group which is bonded to a coupling active position by a nitrogen atom, aryloxy, arylthio, acyloxy, alkylsulfonyloxy, arylsulfonyloxy, heterocyclic oxy, and a halogen atom.

In formula (Y), X preferably represents a heterocyclic group which is bonded to a coupling active position by a nitrogen atom, or aryloxy.

When X represents a heterocyclic group, X is a 5- to 7-membered, monocyclic or condensed-ring heterocyclic group which may be preferably substituted. Examples of this heterocyclic ring are succinimide, maleinimide, phthalimide, diglycolimide, pyrrole, pyrazole, imidazole, 1,2,4-triazole, tetrazole, indole, indazole, benzimidazole, benzotriazole, imidazolidine-2,4-dione, oxazolidine-2,4-dione, thiazolidine-2,4-dione, imidazolidine-2-one, oxazolidine-2-one, thiazolidine-2-one, benzimidazoline-2-one, benzoxazoline-2-one, benzothiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone, 2-pyrazone, 2-amino-1,3,4-thiazolidine, and 2-imino-1,3,4-thiazolidine-4-one. These heterocyclic rings may be substituted. Examples of the substituent of these heterocyclic rings are a halogen atom, hydroxyl, nitro, cyano, carboxyl, sulfo, alkyl, aryl, alkoxy, aryloxy, alkylthio, arylthio, alkylsulfonyl, arylsulfonyl, alkoxycarbonyl, aryloxycarbonyl, acyl, acyloxy, amino, carbonamido, sulfonamido, carbamoyl, sulfamoyl, ureido, alkoxycarbonylamino, and sulfamoylamino. When X represents aryloxy, X is preferably aryloxy having 6 to 30 carbon atoms and may be substituted by a group selected from the substituents enumerated above for X as a heterocyclic ring. Preferable examples of the substituent of aryloxy are a halogen atom, cyano, nitro, carboxyl, trifluoromethyl, alkoxycarbonyl, carbonamido, sulfonamido, carbamoyl, sulfamoyl, alkylsulfonyl, arylsulfonyl, and cyano.

Most preferably, X is a group represented by group (Y-1), (Y-2), or (Y-3) described in Table A (to be presented later).

In group (Y-1), Z represents $—O—CR_4R_5—$, $—S—CR_4R_5—$, $—NR_6—CR_4R_5—$, $—NR_6—NR_7—$, $NR_6—CO—$, $—CR_4R_5—CR_8R_9—$, or $CR_{10}=CR_{11}—$. In these compounds, $R_4$, $R_5$, $R_8$, and $R_9$ independently represent a hydrogen atom, alkyl, aryl, alkoxy, aryloxy, alkylthio, arylthio, alkylsulfonyl, or amino. Each of $R_6$ and $R_7$ independently represents a hydrogen atom, alkyl, aryl, alkylsulfonyl, arylsulfonyl, or alkoxycarbonyl. $R_{10}$ and $R_{11}$ independently represent a hydrogen atom, alkyl, or aryl. $R_{10}$ and $R_{11}$ may be bonded together to form a benzene ring. $R_4$ and $R_5$, $R_5$ and $R_6$, $R_6$ and $R_7$, or $R_4$ and $R_8$ may be bonded together to form a ring (e.g., cyclobutane, cyclohexane, cycloheptane, cyclohexene, pyrrolidine, or piperidine).

The most preferable one of heterocyclic groups represented by group (Y-1) is one in which Z represents $—O—CR_4R_5—$, $—NR_6—CR_4R_5—$, or $—NR_6—NR_7—$ in group (Y-1). The number of carbon atoms of a heterocyclic group represented by group (Y-1) is 2 to 30, preferably 4 to 20, and more preferably 5 to 16.

In group (Y-2), at least one of $R_{12}$ and $R_{13}$ is a halogen atom, cyano, nitro, trifluoromethyl, carboxyl, alkoxycarbonyl, carbonamido, sulfonamido, carbamoyl, sulfamoyl, alkylsulfonyl, arylsulfonyl, or acyl, and the other may be a hydrogen atom, alkyl, or alkoxy. $R_{14}$ represents a group having the same meaning as $R_{12}$ or $R_{13}$, and m represents an integer of 0 to 2. The number of carbon atom of aryloxy represented by group (Y-2) is 6 to 30, preferably 6 to 24, and more preferably 6 to 15.

In group (Y-3), W represents non-metallic atoms required together with N to form a pyrrole ring, a pyrazole ring, an imidazole ring, or a triazole ring. In this case, a ring represented by group (Y-3) may have a substituent. Preferable examples of the substituent are a halogen atom, nitro, cyano, alkoxycarbonyl, alkyl, aryl, amino, alkoxy, aryloxy, and carbamoyl. The number of carbon atom of a heterocyclic group represented by group (Y-3) is 2 to 30, preferably 2 to 24, and more preferably 2 to 16.

Most preferably, X is a group represented by group (Y-1). A coupler represented by formula (Y) may form polymers which are dimers or higher polymers to be bonded together via a divalent group or a higher group in the substituent $R_1$, X, or group (Y-a) described in Table A (to be presented later). In this case, the number of carbon atom may fall outside the range defined in each substituent described above.

Examples of a yellow coupler represented by formula (Y) will be listed in Tale D (to be presented later).

Other examples of the yellow coupler for use in the present invention and/or methods of synthesizing these yellow couplers are described in, e.g., U.S. Pat. Nos. 3,227,554, 3,408,194, 3,894,875, 3,933,501, 3,973,968, 4,022,620, 4,057,432, 4,115,121, 4,203,768, 4,248,961, 4,266,019, 4,314,023, 4,327,175, 4,401,752, 4,404,274, 4,420,556, 4,711,837, and 4,729,944, EP 30,747A, EP 284,081A, EP 296,793A, EP 313,308A, West German Patent 3,107,173C, JP-A-58-42044, JP-A-59-174839, JP-A-62-276547, and JP-A-63-123047.

A phenolic cyan coupler which can be preferably used in the present invention or can be used together with the compound of the present invention is represented by formula (C-I) or (C-II) described in Table A (to be presented later).

In formula (C-I) or (C-II), $R_1$ represents alkyl, aryl, or a heterocyclic group, $R_2$ represents a hydrogen atom, alkyl, or aryl, $R_3$ represents a hydrogen atom, a halogen atom, alkyl, aryl, alkoxy, aryloxy, carbonamido, or ureido, $R_4$ represents a group having the same meaning as $R_1$, alkoxy, aryloxy, or amino, X represents a hydrogen atom or a coupling split-off group, and n represents an integer of 0 or 1.

A phenolic cyan coupler represented by formula (C-I) or (C-II) will be described in detail below.

In formula (C-I) or (C-II), $R_1$ represents straight-chain, branched-chain, or cyclic alkyl having 1 to 36 (preferably 1 to 24) carbon atoms, which may contain an unsaturated bond and may be substituted, aryl having 6 to 36 (preferably 6 to 24) carbon atoms, which may be substituted, or a heterocyclic group having 2 to 36 (preferably 2 to 24) carbon atoms, which may be substituted. In this case, the heterocyclic group means a 5- to 7-membered heterocyclic group which has at least one hetero atom selected from N, 0, S, P, Se, and Te in its ring and may be condensed. Examples of the heterocyclic group are 2-furyl, 2-thienyl, 4-pyridyl, 2-imidazolyl, and 4-quinolyl. Examples of the substituent of $R_1$ are a halogen atom, cyano, nitro, carboxyl, sulfo, alkyl, aryl, a heterocyclic group, alkoxy, aryloxy, alkylthio, arylthio, alkylsulfonyl, arylsulfonyl, alkoxycarbonyl, aryloxycarbonyl, acyl, carbonamido, sulfonamido, carbamoyl, sulfamoyl, ureido, alkoxycarbonylamino, and sulfamoylamino (to be referred to as substituents group A). Preferable substituents are halogen atoms (F, Cl, Br, and I), cyano, alkyl, aryloxy, alkylsulfonyl, arylsulfonyl, carbonamido, or sulfonamido. $R_1$ is preferably alkyl in formula (C-I) and is preferably alkyl or aryl in formula (C-II).

In formula (C-I), $R_2$ is a hydrogen atom, straight-chain, branched-chain, or cyclic alkyl having 1 to 36 (preferably 1 to 24) carbon atoms, or aryl having 6 to 36 (preferably 6 to 24) carbon atoms, which may be substituted. $R_2$ is preferably alkyl (e.g., methyl, ethyl, propyl, isopropyl, t-butyl, or cyclopentyl) having 1 to 8 carbon atoms.

In formula (C-I) or (C-II), $R_3$ is a hydrogen atom, a halogen atom (F, Cl, Br, or I), straight-chain, branched-chain, or cyclic alkyl having 1 to 16 (preferably 1 to 8) carbon atoms, aryl having 6 to 24 (preferably 6 to 12) carbon atoms, alkoxy having 1 to 24 (preferably 1 to 8) carbon atoms, aryloxy having 6 to 24 (preferably 6 to 12) carbon atoms, carbonamide having 1 to 24 (preferably 2 to 12) carbon atoms, or ureido having 1 to 24 (preferably 1 to 12) carbon atoms. When $R_3$ is alkyl, aryl, alkoxy, aryloxy, carbonamido, or ureido, it may be substituted by a substituent selected from the substituents A described above. $R_3$ is preferably a halogen atom in formula (C-I) and is preferably a hydrogen atom, a halogen atom, alkoxy, or carbonamide, and most preferably a hydrogen atom in formula (C-II). In formula (C-II), $R_3$ and $R_4$ may be bonded together to form a ring. In this case, $R_3$ may be a constituting element of the ring, as a single bond or an imino group.

In formula (C-II), $R_4$ is a group having the same meaning as $R_1$, alkoxy having 1 to 36 (preferably 1 to 24) carbon atoms, aryloxy having 6 to 36 (preferably 6 to 24) carbon atoms, alkyl having 1 to 36 (preferably 1 to 24) carbon atoms, or aryl-substituted amino. $R_4$ is preferably a group having the same meaning as $R_1$, and more preferably alkyl.

In formula (C-I) or (C-II), X represents a hydrogen atom or a coupling split-off group which can split off by a coupling reaction with the oxidized form of an aromatic primary amine developing agent. Examples of the coupling split-off group are halogen atoms (F, Cl, Br, and I), sulfo, alkoxy having 1 to 36 (preferably 1 to 24) carbon atoms, aryloxy having 6 to 36 (preferably 6 to 24) carbon atoms, acyloxy having 2 to 36 (preferably 2 to 24) carbon atoms, alkyl or arylsulfonyloxy having 1 to 36 (preferably 1 to 24) carbon atoms, alkyl having 1 to 36 (preferably 1 to 24) carbon atoms, imide having (preferably 4 to 24), carbamoyloxy having 1 to 36 (preferably 1 to 24) carbon atoms, or a heterocyclic group (e.g., tetrazole-5-yl, pyrazolyl, imidazolyl, or 1,2,4-triazole-1-yl). These groups, except for alkoxy, may be substituted by a group selected from the substituents A. X is preferably a hydrogen atom, a fluorine atom, a chlorine atom, sulfo, alkoxy, or aryloxy, and most preferably a hydrogen atom or a chlorine atom.

In formula (C-I) or (C-II), n represents an integer of 0 or 1, and preferably 0.

Examples of the substituent in formula (C-I) or (C-II) will be listed in Table E (to be presented later).

Examples (C-1 to C-10) of a coupler represented by formula (C-I) and examples (C-11 to C-25) of a coupler represented by formula (C-II) will be listed in Table F (to be presented later).

Other examples and methods of synthesizing these cyan couplers are described in, e.g., U.S. Pat. Nos. 2,369,929, 2,772,162, 2,895,826, 3,772,002, 4,327,173, 433,999, 4,334,011, 4,430,423, 4,500,635, 4,518,687, 4,564,586, 4,609,619, 4,686,177, and 4,746,602, and JP-A-59-164555.

In the present invention, couplers having a heterocyclic skeleton can be used. Examples of the usable cyan coupler are 3-hydroxypyridines (compound CC-1 described in Table G to be presented later) described in EP 0333185A, condensed-ring triazoles (compound CC-2 described in Table G to be presented later) described in EP 0342637A2, 3H-2-dicyanomethylidenethiazoles (compound CC-3 described in Table G to be presented later) described in EP 0362808A2, 3-dicyanomethylidene-2,3-dihydrobenzothiophene-1,1-dioxides (compound CC-4 described in Table G to be presented later) described in JP-A-64-32260, pyrazoloazoles (compound CC-5 described in Table G to be presented later) described in JP-A-63-264753, imidazoles (compounds CC-6 and CC-7 described in Table G to be presented later) described in U.S. Pat. Nos. 818,672 and 4,921,783, pyrazoloazoles (compounds CC-8 and CC-9 described in Table G to be presented later) described in U.S. Pat. No. 4,873,183, pyrazolopyrimidones described in EP 0304001A2, EP 0329036A, EP 0374781A2, and JP-A-2-85851, and pyrazoloquinazolones (compounds CC-10, CC-11, CC-12, CC-13, and CC-14 described in Table G to be presented later).

In the present invention, a discoloration inhibitor can be used as needed. Discoloration inhibitors for use in the present invention are represented by formulas (A-I) to (A-IV) described in Table A (to be presented later).

In formula (A-I), R represents a hydrogen atom, alkyl, alkenyl, aryl, a heterocyclic group, silyl, phosphino, or a protective group capable of deprotection under alkaline conditions, X represents —O—, —S—, or —NR'— wherein R' represents a group defined by R, and $R_1$ to $R_5$ may be the same or different and them independently represent a hydrogen atom, —X—R, alkyl, alkenyl, aryl, a heterocyclic group, alkyloxycarbonyl, aryloxycarbonyl, a halogen atom, acyl, sulfonyl, carbamoyl, sulfamoyl, cyano, nitro, sulfo, or carboxyl.

In formula (A-I), of —X—R and groups of $R_1$ to $R_5$, substituents at ortho positions may be bonded together to form a 5- to 7-membered ring.

Substituents in formulas (A-I) to (A-IV) will be described below. $R_{10}$ represents a hydrogen atom, alkyl, alkenyl, aryl, oxyradical, hydroxy, acyl, sulfonyl, or sulfinyl. $R_{11}$ to $R_{14}$ may be the same or different and independently represent a hydrogen atom or alkyl. A represents non-metallic atoms required to form a 5- to 7-membered ring.

M represents copper, cobalt, nickel, palladium, or platinum. $R_{20}$, $R_{21}$, $R_{22}$, $R'_{20}$, $R'_{21}$, and $R'_{22}$ may be the same or different and independently represent a hydrogen atom, alkyl, or aryl. $R_{23}$ and $R'_{23}$ may be the same or different and independently represent a hydrogen atom, alkyl, aryl, hydroxyl, alkoxy, or aryloxy. $R_{23}$ and $R'_{23}$ may be bonded together. Of the groups of $R_{20}$ to $R_{23}$ or $R'_{20}$ to $R'_{23}$, adjacent groups may be bonded together to form an aromatic ring or a 5- to 8-membered ring. B represents a compound which can be coordinated in M. The conformation number of this compound is 1 to 5.

Of the groups defined in formulas (A-I) to (A-IV), groups having a carbon atom can further have a substituent on the carbon atom.

Of compounds represented by formulas (A-I) to (A-IV), compounds represented by (A-I) to (A-III) are preferred. Of compounds represented by formula (A-I), preferable compounds are those enumerated below.

1) A compound in which X is —O— and at least one of $R_1$ to $R_5$ is —X—R.

2) A compound in which —X—R is —OH and $R_3$ is aryloxycarbonyl.

3) A compound in which X is —O— and $R_1$ is substituted benzyl.

4) A compound in which X is —O— and $R_1$ is amido.

In a compound represented by formula (A-II), A preferably forms a 5- or 6-membered ring. In a compound represented by formula (A-III), M preferably represents nickel, and $R_{20}$ and $R_{21}$, and $R'_{20}$ and $R'_{21}$ preferably form aromatic rings.

Representative examples of compounds represented by formulas (A-I) to (A-IV) will be described in Table H (to be presented later), but compounds usable in the present invention are not limited to these examples.

Other preferable examples of compounds represented by formulas (A-I) to (A-IV) of the present invention and methods of synthesizing the same are described in, e.g., U.S. Pat. Nos. 2,735,765, 3,432,300, 3,573,050, 3,574,627, 3,698,909, 3,700,455, 3,764,337, 3,930,866, 3,982,944, 4,113,495, 4,120,723, 4,155,765, 4,254,216, 4,245,018, 4,268,593, 4,273,864, 4,279,990, 4,332,836, 4,360,589, 4,430,425, 4,483,918, 4,540,653, 4,559,297, 4,745,050, and 4,749,645, British Patents 1,156,167, 2,039,068, 2,043,931, and 2,066,975, Published Unexamined European Patents 98,241, 176,845, 178,165, 264,730, 268,496, 273,412, and 298,321, JP-B-60-24455 ("JP-B" means Examined Published Japanese Patent Application), JP-A-59-87456, JP-A-61-258246, and JP-A-63-95440.

Although the use amount of compounds represented by formulas (A-I) to (A-IV) of the present invention depends on couplers used in combination with the compounds, it is $1\times10^{-2}$ to 10 mols, and preferably $3\times10^{-2}$ to 5 mols per mol of a coupler. If the amount is less than these values, it becomes difficult to achieve the effects of the present invention. If the amount is more than the values, a color forming reaction may be inhibited.

The total amount of silver halide emulsions contained in the color photographic light-sensitive material of the present invention is, in silver coating amount, 0.78 $g/m^2$ or less, and preferably 0.70 $g/m^2$ or less. The total amount of silver halide emulsions contained in cyan image forming layers is preferably 0.25 $g/m^2$ or less, and more preferably 0.21 $g/m^2$ or less in silver coating amount.

The optical reflection density of the light-sensitive material in the present invention is measured by a reflection densitometer commonly used in this field of art, and is defined as follows. Note that in order to eliminate measurement errors caused by light transmitted through a sample, a standard reflecting plate is set on the rear side of each sample at the time of measurement.

$$\text{Optical reflection density} = \log_{10}(F0/F)$$

$F_0$: luminous flux reflected by a standard white plate
F: luminous flux reflected by a sample An optical reflection density necessary in the present invention is 0.50 or more for a measurement wavelength of 680 nm. If the density is 0.5 or less, an effect of improving sharpness is insignificant. Preferably, the density is 0.5 to 2.0. If the density is 2.0 or more, color remaining after the processing is notable. More preferably, the density is 0.5 to 1.5.

In order to obtain the optical reflection density of the present invention, an addition amount of dyes can be adjusted. These dyes can be added singly, or a plurality of dyes may be used together. Layers to which these dyes are added are not particularly limited, so that the dyes can be added to layers between a lowest light-sensitive layer and a support, light-sensitive layers, interlayers, a protective layer, and layers between the protective layer and an uppermost light-sensitive layer.

Dyes for achieving the above object are selected from those not essentially, spectrally sensitizing a silver halide.

As a method of adding these dyes, conventional methods can be applied. For example, dyes can be dissolved in water or alcohols such as methanol and added.

During a time interval from coating to drying of the light-sensitive material, dyes added to the above-mentioned layers may be present in the form in which they are diffused in all layers, or may be fixed to a specific layer.

Examples of the dye for accomplishing the objects of the present invention are various dyes, such as an oxonol dye having a pyrazolone nucleus or a barbituric acid nucleus, an azo dye, an azomethine dye, an anthraquinone dye, an arylidene dye, a styryl dye, a triarylmethane dye, a merocyanine dye, and a cyanine dye.

Of these dyes, examples of dyes most preferably used in the present invention are those (particularly an oxonol dye) described in EP 0337490, pp. 9 to 71.

A silver halide emulsion used in the present invention is a silver chloride, silver chlorobromide, or silver chloroiodobromide emulsion having an average silver chloride content of 90 mol % or more, and preferably 95 mol % or more. A larger silver chloride content is preferable for rapid processing.

The light-sensitive material according to the present invention preferably contains, in order to improve, for example, the sharpness of an image, 12 wt % or more (more preferably 14 wt % or more) of titanium oxide, which is surface-treated with divalent to tetravalent alcohols (e.g., trimethylolethane), in a water-resistant resin layer of a support.

The light-sensitive material of the present invention also preferably contains a dye image storage stability improving compound as described in EPO 277,589A2 in combination with couplers, particularly with a pyrazoloazole coupler.

That is, it is preferable to use a compound, which chemically bonds to an aromatic amine developing agent remaining after color development to produce a chemically inactive, essentially colorless compound and/or a compound, which chemically bonds to an oxidized form of an aromatic amine color developing agent remaining after color development to produce a chemically inactive, essentially colorless compound, in preventing side effects such as stains caused by color dyes produced during storage after the processing by a reaction between the residual color developing agent or its oxidized form in a film and couplers.

In order to prevent various mildew and bacteria which multiply in hydrophilic colloid layers to deteriorate an image, the light-sensitive material according to the present invention preferably contains a mildew-proofing agent as described in JP-A-63-271247.

As a support used in the light-sensitive material of the present invention, a white polyester support, or a support in which a layer containing a white pigment is formed on the side of the support having silver-halide emulsion layers may be used for an application as a display. In addition, in order to improve sharpness, an antihalation layer is preferably coated on the side of the support where silver halide emulsion layers are coated, or the rear surface of the support. In particular, the transmission density of the support is preferably set within a range of 0.35 to 0.8 so that a display can be monitored with either reflected light or transmitted light.

The light-sensitive material according to the present invention may be exposed with either visible light or infrared light. The exposure method may be either low-intensity exposure or high-intensity, short-time exposure. Especially in the latter case, a laser scanning exposure scheme in which an exposure time per pixel is shorter than $10^{-4}$ sec. is preferable.

In the exposure, a band stop filter described in U.S. Pat. No. 4,880,726 is preferably used. By this filter, optical color mixing is removed to notably improve color reproducibility.

An exposed light-sensitive material is preferably subjected to b each-fixing after color development for the purpose of rapid processing. Especially when the high silver chloride emulsion described above is used, the pH of a bleach-fixing solution is preferably about 6.5 or less, and more preferably about 6 or less in order to accelerate desilvering.

After imagewise exposure, the light-sensitive material of the present invention is preferably developed with a color developer not essentially containing benzyl alcohol. The color developer not essentially containing benzyl alcohol means a color developer in which an amount of benzyl alcohol contained per liter of the color developer at 25° C. is 2 ml (about 2.08 g) or less, and preferably 1 ml or less.

As photographic constituting elements to be applied to the light-sensitive material according to the present invention, for example, silver halide emulsions and other materials (e.g., additives), photographic constituting layers (e.g., a layer arrangement), and methods and additives used to process the light-sensitive material, it is preferable to use those described in published unexamined patent applications in Table 2 below, particularly EPO 355,660A2 (JPA-139544).

TABLE 2

| Photographic constituting element | JP-A-62-215272 | JP-A-2-33144 | EPO 355,660A2 |
|---|---|---|---|
| Silver halide emulsion | Line 6, upper right column, page 10 to line 5, lower left column, page 12, and line 4 from the bottom, lower right column, page 12 to line 17, upper left column, page 13 | Line 16, upper right column, page 28 to line 11, lower right column, page 29, and lines 2 to 5, page 30 | Line 53, page 45 to line 3, page 47, and lines 20 to 22, page 47 |
| Silver halide solvent | Lines 6 to 14 lower left column, page 12, and line 3, upper left column, page 13 to last line, lower left column, page 18 | — | — |
| Chemical sensitizer | Line 3 from the bottom, lower left column to line 5 from the bottom, lower right column, page 12, and line 1, lower right column, page 18 to line 9 from the bottom, upper right column, page 22 | Line 12 to last line, lower right column, page 29 | Lines 4 to 9, page 47 |
| Spectral sensitizer (spectral sensitizing method) | Line 8 from the bottom, upper right column, page 22 to last line, page 38 | Lines 1 to 13 upper left column, page 30 | Lines 10 to 15, page 47 |
| Emulsion stabilizer | Line 1, upper left column, page 39 to last line, upper right column, page 72 | Line 14, upper left column to line 11, upper right column, page 30 | Lines 16 to 19, page 47 |
| Development accelerator | Line 1, lower left column, page 72 to line 3, upper right column, page 91 | — | — |
| Color couplers (cyan, magenta, and yellow couplers) | Line 4, upper right column, page 91 to line 6, upper left column, page 121 | Line 14, upper right column, page 3 to last line, upper left column, page 18, and line 6, upper right column, page 30 to line 11, lower right column, page 35 | Lines 15 to 27, page 4, line 30, page 5 to last line, page 28, lines 29 to 31, page 45, and line 23, page 47 to line 50, page 63 |
| Color booster | Line 7, upper left column, page 121 to line 1, upper right column, page 125 | — | — |
| Ultra-violet absorbent | Line 2, upper right column, page 125 to last line, lower left column, page 127 | Line 14, lower right column, page 37 to line 11, upper left column, page 38 | Lines 22 to 31, page 65 |
| Discoloration inhibitor (image stabilizer) | Line 1, lower right column, page 127 to line 8, lower left column, page 137 | Line 12, upper right column, page 36 to line 19, upper left column, page 37 | Line 30, page 4 to line 23, page 5, line 1, page 29 to line 25, page 45, lines 33 to 40, page 45, and lines 2 to 21, page 65 |
| High abd/or low | Line 9, lower left column, page 137 to | Line 14, lower right column, page 35 to | Lines 1 to 51, page 64 |

TABLE 2-continued

| Photographic constituting element | JP-A-62-215272 | JP-A-2-33144 | EPO 355,660A2 |
|---|---|---|---|
| boiling point organic solvents | last line, upper right column, page 144 | line 4 from the bottom, upper left column, page 36 | |
| Method of dispersing photographic additives | Line 1, lower left column, page 144 to line 7, upper right column, page 146 | Line 10, lower right column, page 27 to last line, upper left column, page 28, and line 12, lower right column, page 35 to line 7, upper right column, page 36 | Line 51, page 63 to line 56, page 64 |
| Film hardener | Line 8, upper right column, page 146 to line 4, lower left column, page 155 | — | — |
| Developing agent precursor | Line 5, lower left column, page 155 to line 2, lower right column, page 155 | — | — |
| Development inhibitor releasing compound | Lines 3 to 9, lower right column, page 155 | — | — |
| Support | Line 19, lower right column, page 155 to line 14, upper left column, page 156 | Line 18, upper right column, page 38 to line 3, upper left column, page 39 | Line 29, page 66 to line 13, page 67 |
| Arrangement of light-sensitive material layers | Line 15, upper left column, page 156 to line 14, lower right column, page 156 | Lines 1 to 15, upper right column, page 28 | Lines 41 to 52, page 45 |
| Dye | Line 15, lower right column, page 156 to last line, lower right column, page 184 | Line 12, upper left column to line 7, upper right column, page 38 | Lines 18 to 22, page 66 |
| Color mixing inhibitor | Line 1, upper left column, page 185 to line 3, lower right column, page 184 | Lines 8 to 11, upper right column, page 36 | Line 57, page 64 to line 1, page 65 |
| Gradation adjusting agent | Lines 4 to 8, lower right column, page 188 | — | — |
| Stain inhibitor | Line 9, lower right column, page 188 to line 10, lower right column, page 193 | Last line, upper left column to line 13, lower right column, page 37 | Line 32, page 65 to line 17, page 66 |
| Surfactant | Line 1, lower left column, page 201 to last line, upper right column, page 210 | Line 1, upper right column, page 18 to last line, lower right column, page 24, and line 10 from the bottom, lower left column to line 9, lower right column, page 27 | — |
| Fluorine-containing compound (to be used as, e.g., antistatic agent, coating aid, lubricant, and antiadhesion agent) | Line 1, lower left column, page 210 to line 5, lower left column, page 222 | Line 1, upper left column, page 25 to line 9, lower right column, page 27 | — |
| Binder (hydrophilic colloid) | Line 6, lower left column, page 222 to last line, upper left column, page 225 | Lines 8 to 18, upper right column, page 38 | Lines 23 to 28, page 66 |
| Thickening agent | Line 1, upper right column, page 225 to line 2, upper right column, page 227 | — | — |
| Antistatic agent | Line 3, upper right column, page 227 to line 1, upper left column, page 230 | — | — |
| Polymer latex | Line 2, upper left column, page 230 to last line, page 239 | — | — |
| Matting agent | Line 1, upper left column, page 240 to last line, upper right column, page 240 | — | — |
| Photographic processing method (e.g., processing steps or additives) | Line 7, upper right column, page 3 to line 5, upper right column, page 10 | Line 4, upper left column, page 39 to last line, upper left column, page 42 | Line 14, page 67 to line 28, page 69 |

In Table 2, a portion cited from JP-A-62-215272 includes the contents amended by the amendment, dated Mar. 16, 1987, described at the end of JP-A-62-215272.

Of the above color couplers, it is preferable to use, as a yellow coupler, so-called short-wave yellow couplers described in JP-A-63-231451, JP-A-63-123047, JP-A-63-241547, JP-A-1-173499, JP-A-1-213648, and JP-A-1-250944.

As a cyan coupler, in addition to a diphenylimidazole cyan coupler described in JP-A-2-33144, it is also preferable to use 3-hydroxypyridine cyan couplers (particularly a two-equivalent polymer obtained by introducing a chlorine split-off group to a 4-equivalent coupler of a coupler (42) enumerated as a practical example, or a coupler (6) or (9) is most preferable) described in EPO 333,185A2, or a cyclic active methylene cyan coupler (particularly couplers 3, 8, and 34 enumerated as practical examples are most preferable) described in JP-A-64-32260.

EXAMPLE 1

After corona discharge processing was performed on the surface of a paper support, both the surfaces of which were laminated with polyethylene, a gelatin undercoating layer containing, e.g., dodecylbenzene-sulfonic acid was formed on the support, and various photographic constituting layers were coated on it, thus manufacturing a sample of multilayered color photographic paper having the following layer arrangement. The coating solutions were prepared as follows.

Preparation of coating solution of layer 1

27.2 cc of ethyl acetate and 4.1 g of each of solvents (Solv-3) and (Solv-7) were added to 19.1 g of a yellow coupler (ExY), 4.4g of a dye image stabilizer (Cpd-1), and 0.7g of a dye image stabilizer (Cpd-7). The resultant solution was emulsion-dispersed in 185 cc of a 10% aqueous gelatin solution containing 8 cc of a 10% sodium dodecylbenzenesulfonate methanol solution, thereby preparing an emulsion dispersion A. In addition, a silver chlorobromide emulsion A (cubic, a 3:7 (silver molar ratio) mixture of a large-size emulsion A having an average grain size of 0.88 μm and a small-size emulsion A having that of 0.70 μm. The variation coefficients of grain size distributions of the large- and small-size emulsions were 0.08 and 0.10, respectively. Each emulsion locally contained 0.3 mol % of silver bromide in a portion of the surface of each silver chloride grain) was prepared. This emulsion was added with blue-sensitive sensitizing dyes A and B described in Table I (to be presented later) each in an amount of $2.0\times10^{-4}$ per mol of a silver halide with respect to the large-size emulsion A, and $2.5\times10^{-4}$ mol with respect to the small-size emulsion A. Chemical ripening of this emulsion was done by adding a sulfur sensitizer and a gold sensitizer. The above emulsion dispersion A and this silver chlorobromide emulsion A were mixed and dissolved to prepare a coating solution of layer 1 so that the composition to be presented later was obtained.

Coating solutions of layers 2 to 7 were prepared following the same procedures as for the coating solution of layer 1. As a gelating hardener for each layer, 1-oxy-3,5-dichloro-s-triazine sodium salt was used.

Cpd-10 and Cpd-11 were added to each layer so that their total amounts were 25.0 mg/m$^2$ and 50.0 mg/m$^2$, respectively.

As spectral sensitizing dyes for the silver chlorobromide emulsion of each light-sensitive emulsion layer, the blue-sensitive emulsion layer was added with, as described above, sensitizing dye A for the blue-sensitive emulsion layer and sensitizing dye B for the blue-sensitive emulsion layer (each in an amount of $2.0\times10^{-4}$ mol per mol of a silver halide with respect to the large-size emulsion A, and $2.5\times10^{-4}$ mol with respect to the small-size emulsion A). A green-sensitive emulsion layer was added with sensitizing dye C for a green-sensitive emulsion layer (in an amount of $4.0\times10^{-4}$ mol per mol of a silver halide with respect to a large-size emulsion B, and $5.6\times10^{-4}$ mol with respect to a small-size emulsion B) and sensitizing dye D for a green-sensitive emulsion layer (in an amount of $7.0\times10^{-5}$ mol per mol of a silver halide with respect to the large-size emulsion B, and $1.0\times10^{-5}$ mol with respect to the small-size emulsion B). A red-sensitive emulsion layer was added with sensitizing dye E for a red-sensitive emulsion layer (in an amount of $0.9\times10^{-4}$ mol per mol of a silver halide with respect to a large-size emulsion C, and $1.1\times10^{-4}$ mol with respect to a small-size emulsion C). The chemical structures of these spectral sensitizing dyes are listed in Table I (to be presented later).

A compound 1 described in Table I (to be presented later) was added in an amount of $2.6\times10^{-3}$ mol per mol of a silver halide to the red-sensitive emulsion layer.

1-(5-methylureidophenyl)-5-mercaptotetrazole was added in amounts of $8.5\times10^{-5}$ mol, $7.7\times10^{-4}$ mol, and $2.5\times10^{-4}$ mol per mol of a silver halide to the blue-, green-, and red-sensitive emulsion layers, respectively.

4-hydroxy-6-methyl-1,3,3a,7-tetrazaindene was added in amounts of $1\times10^{-4}$ mol and $2\times10^{-4}$ mol per mol of a silver halide to the blue- and green-sensitive emulsion layers, respectively.

In addition, in order to prevent irradiation, 10 mg/m$^2$ of a dye 1, 10 mg/m$^2$ of a dye 2, 40 mg/m$^2$ of a dye 3, and 20 mg/m$^2$ of a dye 4, each described in Table I (to be presented later), were added to each emulsion layer.

Layer arrangement

The composition of each layer is presented below. Numerals indicate a coating amount (g/m$^2$). A silver halide emulsion is represented in terms of a silver coating amount.

| | |
|---|---|
| Support | |
| Polyethylene laminated paper (which contains a white pigment ($TiO_2$) and a blue dye (ultramarine blue) in polyethylene on the side of layer 1) | |
| Layer 1 (Blue-sensitive emulsion layer) | |
| Above-mentioned silver chlorobromide emulsion A | 0.30 |
| Gelatin | 1.86 |
| Yellow coupler (ExY) | 0.82 |
| Dye image stabilizer (Cpd-1) | 0.19 |
| Solvent (Solv-3) | 0.18 |
| Solvent (Solv-7) | 0.18 |
| Dye image stabilizer (Cpd-7) | 0.06 |
| Layer 2 (Color mixing inhibiting layer) | |
| Gelatin | 0.99 |
| Color mixing inhibitor (Cpd-5) | 0.08 |
| Solvent (Solv-1) | 0.16 |
| Solvent (Solv-4) | 0.08 |
| Layer 3 (Green-sensitive emulsion layer) | |
| Silver chlorobromide emulsion (cubic, a 1:3 (Ag molar ratio) mixture of a large-size emulsion B having an average grain size of 0.55 fm and a small-size emulsion B having that of 0.39 fm. The variation coefficients of grain size distributions of the large- and small-size emulsions were 0.10 and 0.08, respectively. Each emulsion locally contained 0.8 mol % of AgBr in a portion of the surface of each AgCl grain) | 0.12 |
| Gelatin | 1.24 |
| Magenta coupler (ExM) | 0.23 |
| Dye image stabilizer (Cpd-2) | 0.03 |
| Dye image stabilizer (Cpd-3) | 0.16 |
| Dye image stabilizer (Cpd-4) | 0.02 |
| Dye image stabilizer (Cpd-9) | 0.02 |
| Solvent (Solv-2) | 0.40 |
| Layer 4 (Ultraviolet absorbing layer) | |
| Gelatin | 1.58 |
| Ultraviolet absorbent (UV-1) | 0.47 |
| Color mixing inhibitor (Cpd-5) | 0.05 |
| Solvent (Solv-5) | 0.24 |
| Layer 5 (Red-sensitive emulsion layer) | |
| Silver chlorobromide emulsion (cubic, a 1:4 (Ag molar ratio) mixture of a large-size emulsion C having an average grain size of 0.58 fm and a small-size emulsion C having that of 0.45 μm. The variation coefficients of grain size distributions of the large- and small-size emulsions were 0.09 and 0.11, respectively. Each emulsion locally | 0.23 |

-continued

| | |
|---|---|
| contained 0.6 mol % of AgBr in a portion of the surface of each AgCl grain) | |
| Gelatin | 1.34 |
| Cyan coupler (ExC) | 0.32 |
| Dye image stabilizer (Cpd-2) | 0.03 |
| Dye image stabilizer (Cpd-4) | 0.02 |
| Dye image stabilizer (Cpd-6) | 0.18 |
| Dye image stabilizer (Cpd-7) | 0.40 |
| Dye image stabilizer (Cpd-8) | 0.05 |
| Solvent (Solv-6) | 0.14 |
| Layer 6 (Ultraviolet absorbing layer) | |
| Gelatin | 1.53 |
| Ultraviolet absorbent (UV-1) | 0.16 |
| Color mixing inhibitor (Cpd-5) | 0.02 |
| Solvent (Solv-5) | 0.08 |
| Layer 7 (Protective layer) | |
| Gelatin | 1.33 |
| Acryl-modified copolymer (modification degree = 17%) of polyvinyl alcohol | 0.17 |
| Liquid paraffin | 0.03 |

The chemical structures of the compounds used in the formation of the sample are listed in Table I (to be presented later).

The sample formed as described above was used as light-sensitive material 1-A.

Subsequently, light-sensitive materials 1-B to 1-Q were formed following the same procedures as for the material 1-A except that solvents shown in Table 3 were used in the red sensitive layer of layer 5, and the following manipulation was performed.

First, a sensitometer (FWH type available from Fuji Photo Film. Co. Ltd., color temperature of light source=3,200° K.) was used to apply gradation exposure of a sensitometry three color separation filter to each sample. The exposure in this case was done such that an exposure amount of 250 CMS was attained for an exposure time of 0.1 sec.

By using a paper processor, the exposed samples were subjected to continuous processing (running test) in accordance with the following processing steps and using processing solutions having the following compositions, until the quantity of a replenisher became twice the tank volume of color development.

| Process | Temperature | Time | Replenisher* | Tank volume |
|---|---|---|---|---|
| Color development | 35° C. | 45 sec. | 161 ml | 17 l |
| Bleach-fixing | 30° C.-35° C. | 45 sec. | 215 ml | 17 l |
| Rinsing i) | 30° C.-35° C. | 20 sec. | — | 10 l |
| Rinsing ii) | 30° C.-35° C. | 20 sec. | — | 10 l |
| Rinsing iii) | 30° C.-35° C. | 20 sec. | 350 ml | 10 l |
| Drying | 70° C.-80° C. | 60 sec. | | |

*A replenisher is represented in terms of a quantity per 1 $m^2$ of a light-sensitive material. (3-tank counter flow piping from rinsing iii) to i))

The composition of each processing solution was as follows.

| Color developer | Tank solution | Replenisher |
|---|---|---|
| Water | 800 ml | 800 ml |
| Ethylenediamine-N,N,N,N-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfon amidoethyl)-3-methyl-4-amino aniline sulfate | 5.0 g | 7.0 g |
| N,N-bis(carboxymethyl) hydrazine | 4.0 g | 5.0 g |
| N,N-di(sulfoethyl) hydroxylamine.1Na | 4.0 g | 5.0 g |
| Fluorescent brightener (WHITEX 4B, available from SUMITOMO CHEMICAL CO. LTD.) | 1.0 g | 2.0 g |
| Water to make | 1,000 ml | 1,000 ml |
| pH (25° C.) | 10.05 | 10.05 |

| Bleach-fixing solution (tank solution and replenisher are the same) | |
|---|---|
| Water | 400 ml |
| Ammonium thiosulfate (70%) | 100 ml |
| Sodium sulfite | 17 g |
| Ammonium ethylenediamine iron (III) tetraacetate | 55 g |
| Disodium ethylenediamine tetraacetate | 5 g |
| Ammonium bromide | 40 g |
| Water to make | 1,000 ml |
| pH (25° C.) | 5.5 |
| Rinsing solution (tank solution and replenisher are the same) Ion exchange water (each of calcium and magnesium is 3 ppm or less) | |

Note that after the processing, the concentration of ethylenediamine iron (II) tetraacetate in the bleach-fixing solution was determined with basophenanthroline. The result is that a quantity corresponding to about 13% of ethylenediamine iron (III) tetraacetate was present in the bleach-fixing solution.

Immediately after the processing, the cyan reflection density in a Dmax portion was measured by a Fuji style densitometer (F.S.D). Thereafter, the sample was dipped in a processing agent (N2 used in the bleaching step of CN-16) available from Fuji Photo Film Co., Ltd., at 30° C. for four minutes to return a cyan-leuco body to a dye. The resultant sample was washed with water for three minutes and dried, and the measurement was performed again. A degree of color restoration failure (leuco reduction of a cyan dye) is shown as a color formation ratio in Table 3. In Table 3, color formation ratio=(cyan density before reprocessing/cyan density after reprocessing)×100.

The minimum density (Dmin) and the maximum density (Dmax) of the above sample, which was washed with water for three minutes and dried after the N2 processing, were measured to obtain photographic properties. In addition, after the same light-sensitive material was left to stand at 80° C. for 30 days, the resulting cyan density (Dmax) was measured. The result is shown in Table 3 as a difference (Δ) from the density obtained immediately after the N2 processing. The chemical structures of compounds R-1, R-2, and R-3 described in Table 3 were as shown in Table I (to be presented later). R-1, R-2, and R-3 are compounds described in JP-A-54-31728, JP-A-62-134642, and JP-A-62-283329, respectively.

TABLE 3

| Light-sensitive material | Compound of present invention or comparative example | Photographic properties Dmin | Dmax | Color formation ratio (%) | ΔDR | Remarks |
|---|---|---|---|---|---|---|
| 1-A | solv. 1 | 0.11 | 2.16 | 64 | −0.29 | Comparative example |
| 1-B | R-1 | 0.11 | 2.01 | 82 | −0.20 | " |
| 1-C | R-2 | 0.11 | 1.97 | 81 | −0.16 | " |
| 1-D | R-3 | 0.11 | 1.94 | 84 | −0.16 | " |
| 1-E | 1 | 0.11 | 2.17 | 94 | −0.10 | Present invention |
| 1-F | 4 | 0.11 | 2.16 | 95 | −0.11 | " |
| 1-G | 10 | 0.11 | 2.14 | 93 | −0.10 | " |
| 1-H | 15 | 0.11 | 2.20 | 91 | −0.09 | " |
| 1-I | 19 | 0.11 | 2.19 | 92 | −0.10 | " |
| 1-J | 22 | 0.11 | 2.18 | 94 | −0.11 | " |
| 1-K | 29 | 0.11 | 2.17 | 93 | −0.09 | " |
| 1-L | 33 | 0.11 | 2.14 | 96 | −0.11 | " |
| 1-M | 39 | 0.11 | 2.16 | 92 | −0.10 | " |
| 1-N | 42 | 0.11 | 2.15 | 91 | −0.10 | " |
| 1-O | 50 | 0.11 | 2.14 | 90 | −0.11 | " |
| 1-P | 53 | 0.11 | 2.16 | 91 | −0.09 | " |
| 1-Q | 58 | 0.11 | 2.17 | 91 | −0.09 | " |

As is apparent from Table 3, each compound of the present invention suppresses leuco reduction of a cyan dye and discoloration without decreasing density.

In addition, in each sample using the compound of the present invention, the dispersion state of couplers was good.

EXAMPLE 2

Light-sensitive materials 2-A to 2-Q were formed following the same procedures as for the light-sensitive material 1-A formed in Example 1 except that the solvent in the blue-sensitive layer of layer 1 was altered as shown in Table 4. The resulting light-sensitive materials were processed following the same procedures as in Example 1, and a discoloration test was conducted as follows. That is, each light-sensitive material was left to stand in a xenon fadeometer (90,000 lux) for 10 days, and a discoloration ratio was calculated in terms of a percentage of a density drop from yellow density of 1.5 obtained immediately after the processing.

In addition, the minimum density (Dmin) and the maximum density (Dmax) immediately after the processing were measured to evaluate photographic properties. The results are shown in Table 4.

TABLE 4

| Light-sensitive material | Compound of comparative example or present invention | Photographic properties Dmin | Dmax | Discoloration ratio (%) | Remarks |
|---|---|---|---|---|---|
| 2-A | Solv.3/ Solv.7 | 0.12 | 2.06 | 53 | Comparative example |
| 2-B | R-1 | 0.11 | 1.90 | 73 | Comparative example |
| 2-C | R-2 | 0.11 | 1.80 | 74 | Comparative example |
| 2-D | R-3 | 0.11 | 1.81 | 74 | Present invention |
| 2-E | 2 | 0.11 | 2.10 | 81 | Present invention |
| 2-F | 6 | 0.12 | 2.11 | 84 | Present invention |
| 2-G | 10 | 0.11 | 2.10 | 83 | Present invention |
| 2-H | 11 | 0.12 | 2.12 | 85 | Present invention |
| 2-I | 19 | 0.11 | 2.08 | 85 | Present invention |
| 2-J | 24 | 0.12 | 2.09 | 83 | Present invention |
| 2-K | 31 | 0.12 | 2.10 | 84 | Present invention |
| 2-L | 37 | 0.11 | 2.09 | 85 | Present invention |
| 2-M | 39 | 0.12 | 2.10 | 85 | Present invention |
| 2-N | 44 | 0.12 | 2.11 | 85 | Present invention |
| 2-O | 51 | 0.12 | 2.12 | 84 | Present invention |
| 2-P | 57 | 0.11 | 2.10 | 85 | Present invention |
| 2-Q | 59 | 0.12 | 2.10 | 84 | Present invention |

In Table 4, compounds (R-1) to (R-3) are the same as in Table 3.

As is apparent from Table 4, each compound of the present invention improves yellow color discoloration without lowering the color forming properties.

As has been described above, the silver halide color photographic light-sensitive material of the present invention and the method of processing the same are excellent in dispersion stability and color forming performance of couplers, in stability of a dye image against heat or light, and in a reduction discoloration resistance of a dye image.

TABLE A
(I)
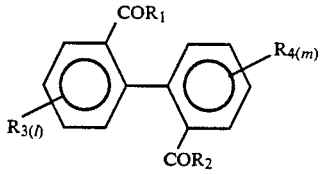
(I-A)
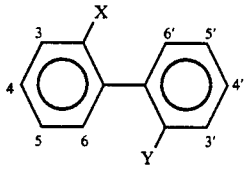
(Y)
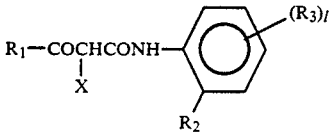
(Y-1)
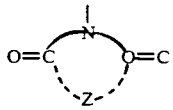
(Y-2)
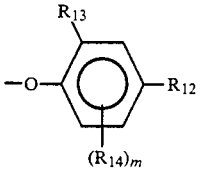
(Y-3)
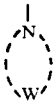
(Y-a)
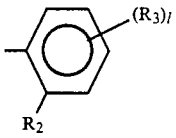
(C-1)
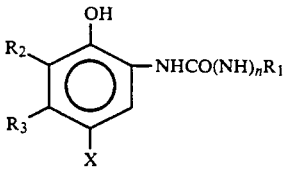
(C-II)
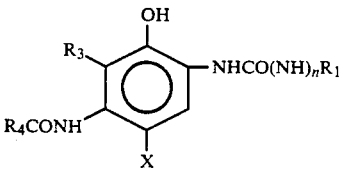
TABLE A-continued
(A-1)
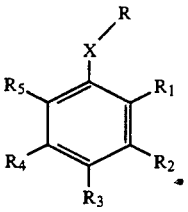
(A-II)
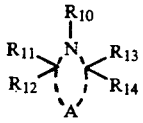
(A-III)
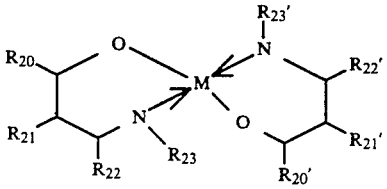
(A-IV)
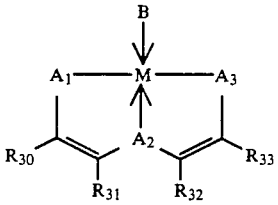
TABLE B
$-NHCH_3$, $-NHC_2H_5$, $-NHC_3H_7$, $-NHCH(CH_3)_2$, $-NHCH_2CH(CH_3)_2$, $-NHC_4H_9$, $-N(C_3H_7)_2$, $-N(C_4H_9)_2$, $-N(C_6H_{13})_2$,
$-N(C_8H_{17})_2$, $-NHC_2\underset{\underset{CH_3}{|}}{C}HC_4H_9$,
$-N(CH_2\underset{\underset{CH_3}{|}}{C}HC_4H_9)_2$, $-NHCH_2CH_2CH_2OC_{12}H_{25}$,
$-NHCH_2\underset{\underset{CH_3}{|}}{C}HCH_2OC_{12}H_{25}$,
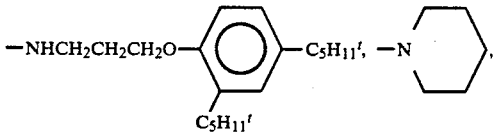
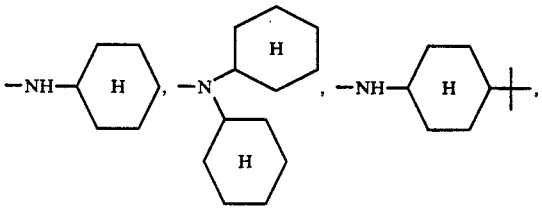
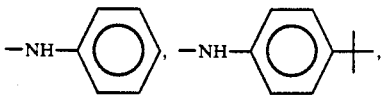

TABLE B-continued
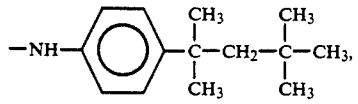
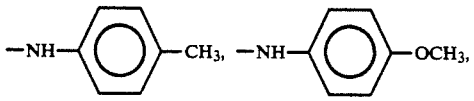
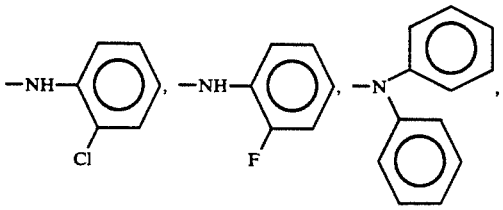
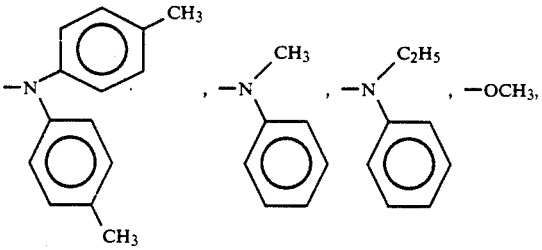
$-OC_2H_5$, $-OC_3H_7$, $-OC_4H_9$, $-OC(CH_3)_3$, $-OCH(CH_3)_2$, $-OCH_2CH(CH_3)_2$, $-OC_6H_{13}$, $-OC_8H_{17}$, $-OC_{10}H_{21}$, $-OC_{12}H_{25}$, $-OC_{16}H_{33}$, $-O(CH_2)_8CH{=}CH(CH_2)_7CH_3$,
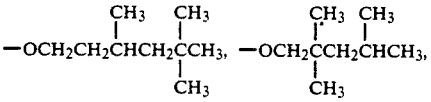
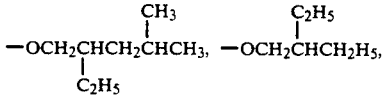
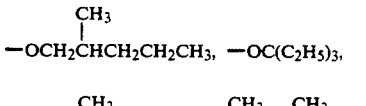
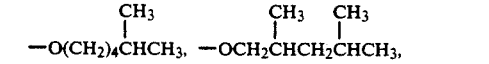
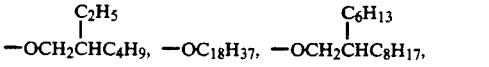
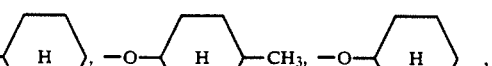
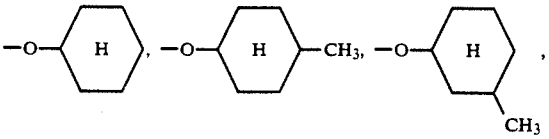
TABLE B-continued
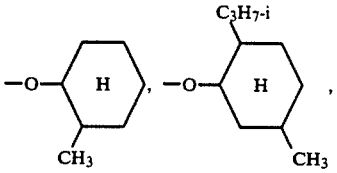
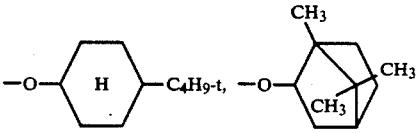
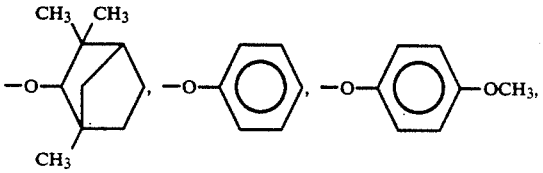
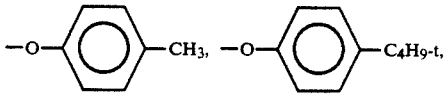
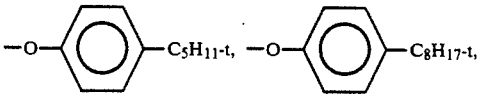
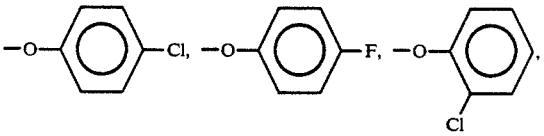
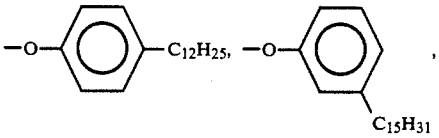
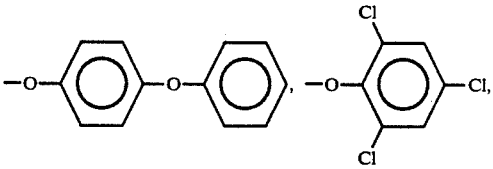
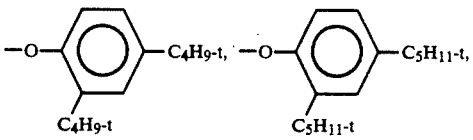

TABLE C
$X_{11}$
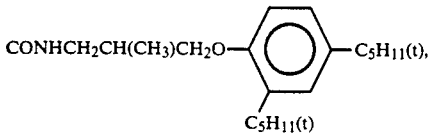
$X_{43}$
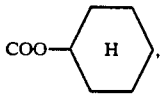
$X_{44}$
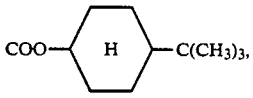
$X_{45}$
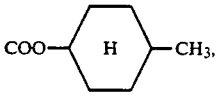
$X_{46}$
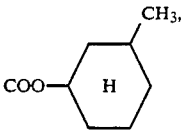
$X_{47}$
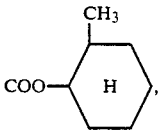
$X_{48}$
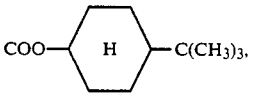
$X_{50}$
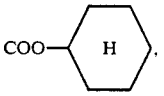
$X_{51}$
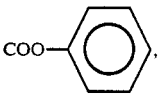
TABLE C-continued
$X_{52}$
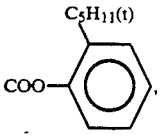
$X_{53}$
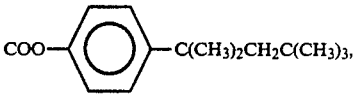
$X_{54}$
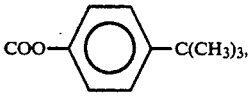
$X_{55}$
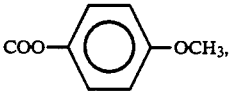
$X_{56}$
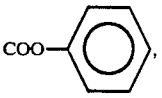
$X_{57}$
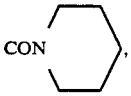
$X_{58}$
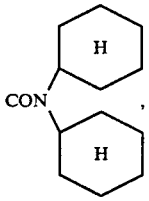
$X_{59}$
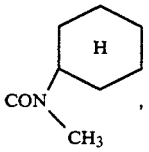
$X_{60}$
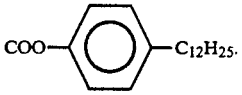
TABLE D
Y-1
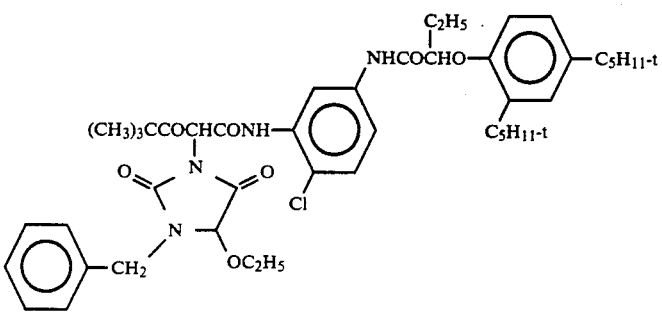

TABLE D-continued
Y-2
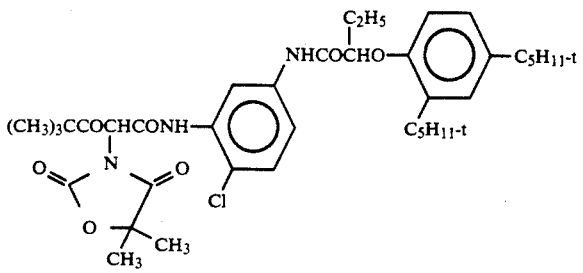
Y-3
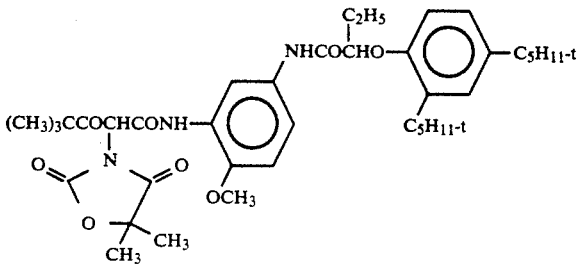
Y-4
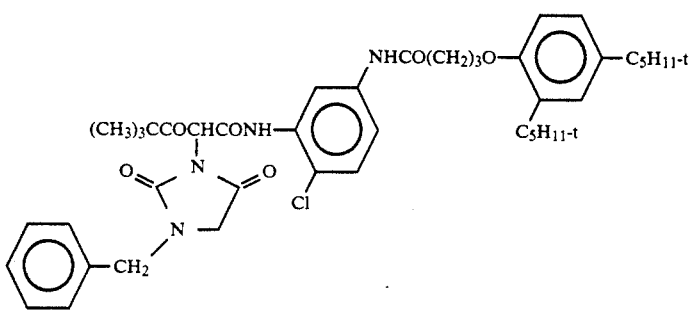
Y-5
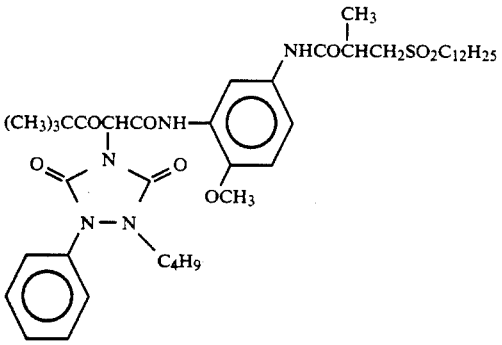
Y-6
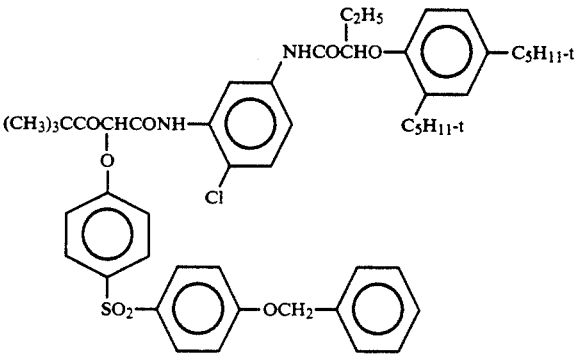

TABLE D-continued
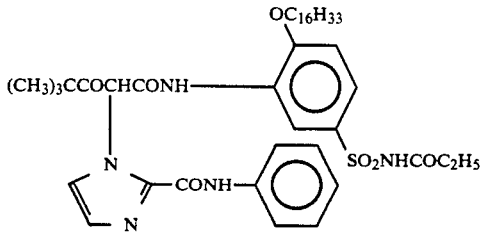
Y-7
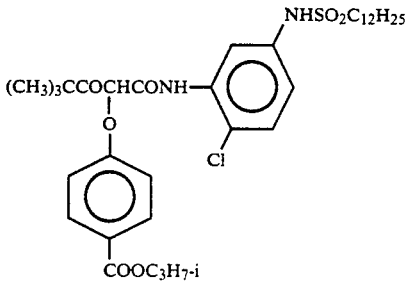
Y-8
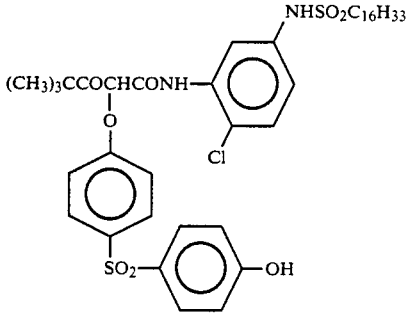
Y-9
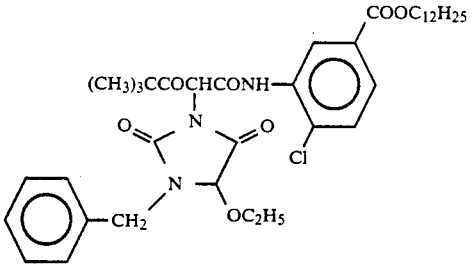
Y-10
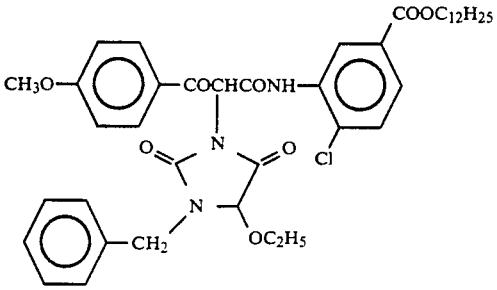
Y-11

TABLE D-continued
Y-12
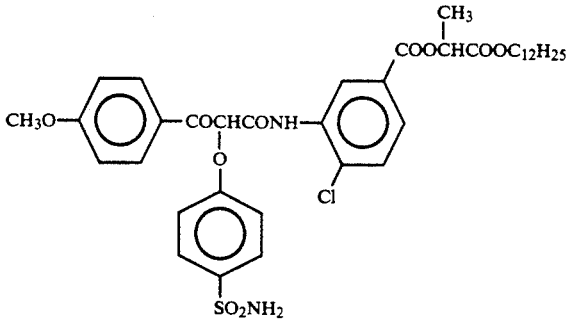
Y-13
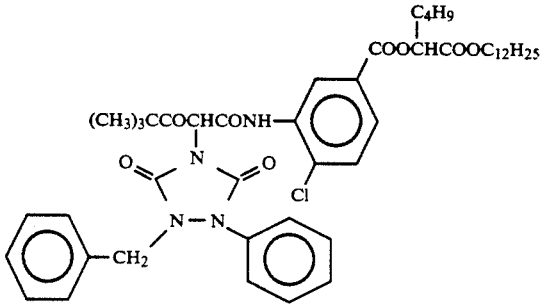
Y-14
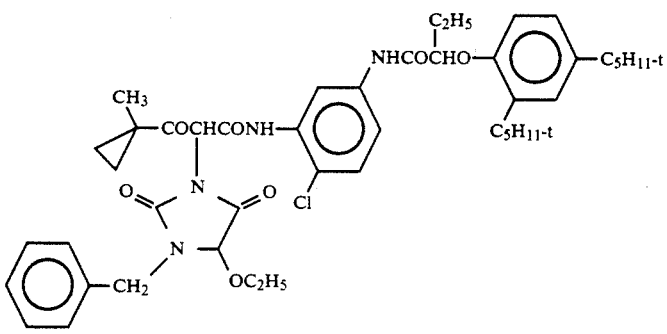
Y-15
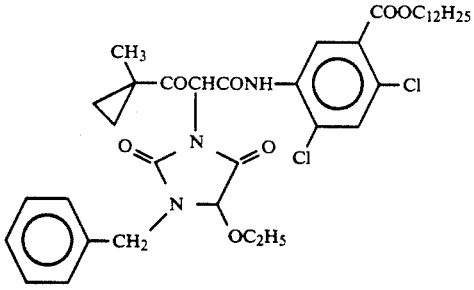
Y-16
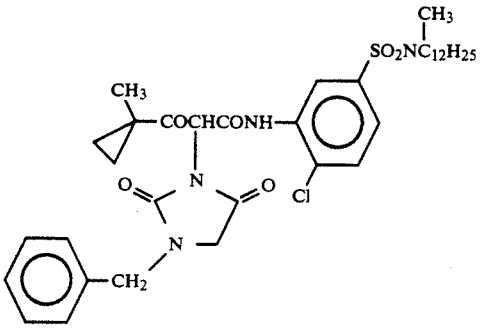

TABLE D-continued
Y-17
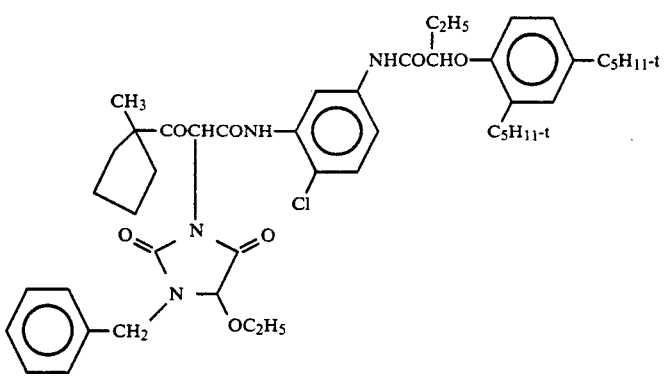
Y-18
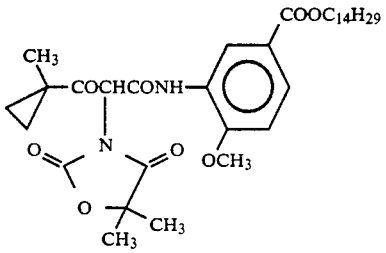
Y-19
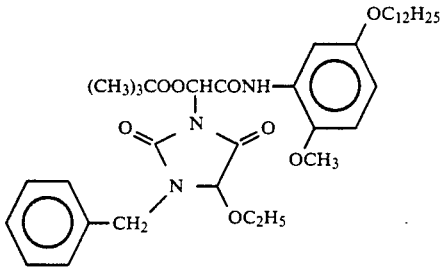
Y-20
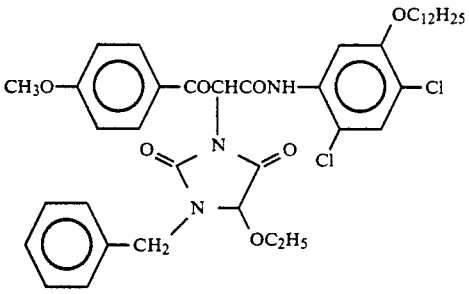
TABLE E
$R_1$:
$-CF_3$, $-C_3F_7$, $-(CF_2)_4H$, $-C_{15}H_{31}(n)$, $-CH(C_6H_{13})C_8H_{17}$,
$-CH(C_7H_{15})C_9H_{19}$, $-CH(C_8H_{17})C_{10}H_{21}$, $-CH_2O-C_6H_3(C_5H_{11}\text{-}t)_2$,
TABLE E-continued
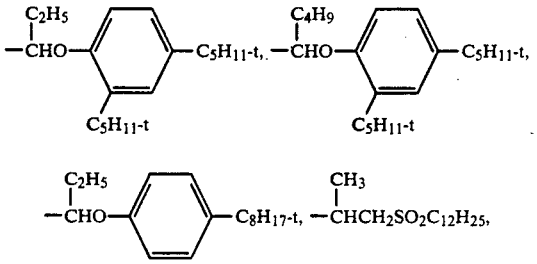

TABLE E-continued
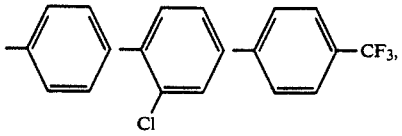
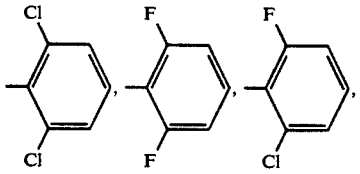
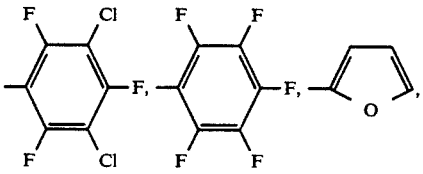
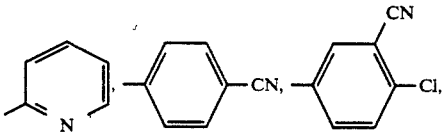
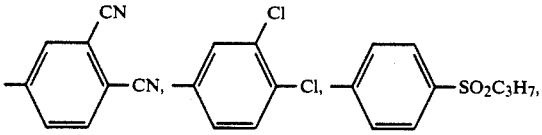
$R_2$:
—H, —$CH_3$, —$C_2H_5$, i-$C_3H_7$, n-$C_4H_9$—, t-$C_4H_9$—,
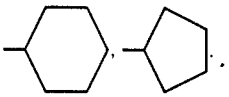
$R_3$:
—H, —F, —Cl, —$CH_3$, 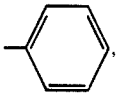 , —$OCH_3$,
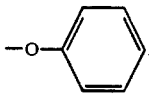 , —$NHCOCH_3$.
$R_4$:
the examples for $R_1$ and,
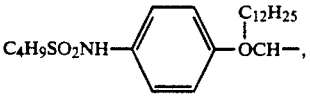
TABLE E-continued
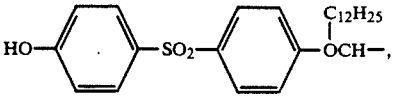
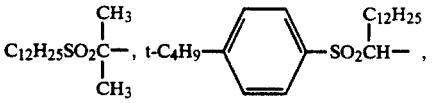
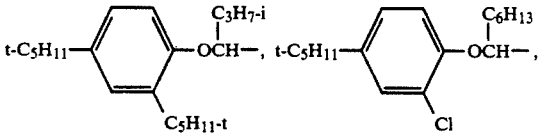
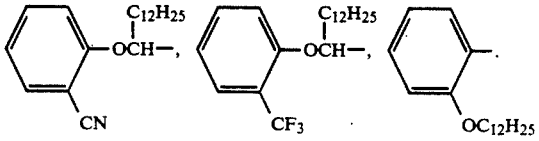
X:
—H, —F, —Cl, —Br, —I, —$SO_3H$, —$OCH_2COOCH_3$,
—$OCH_2CH_2CH_2COOH$, —$OCH(CH_3)COOH$,
—$OCH_2CH_2SCH_2COOH$, —$OP(=O)(OC_2H_5)_2$,
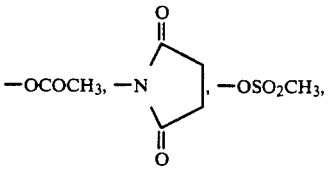
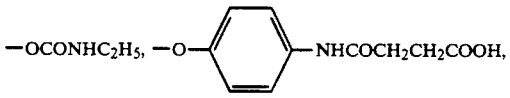
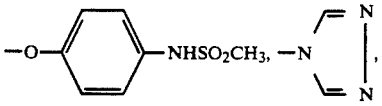
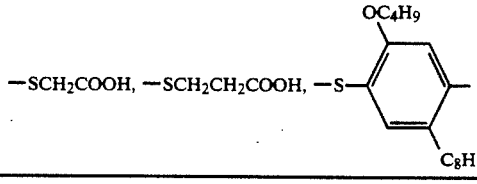
TABLE F
C-1
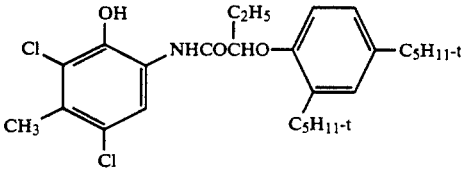
C-2
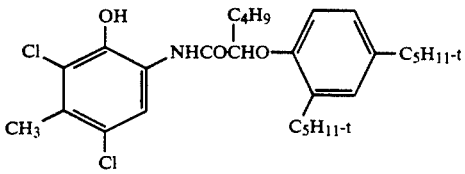

TABLE F-continued
C-3
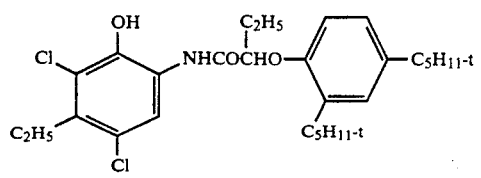
C-4
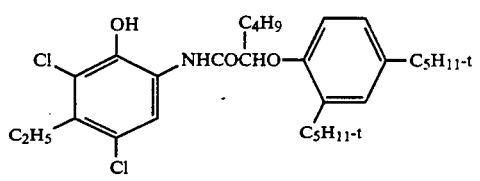
C-5
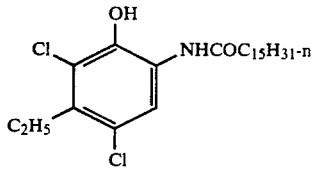
C-6
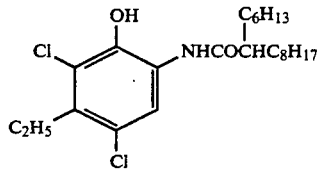
C-7
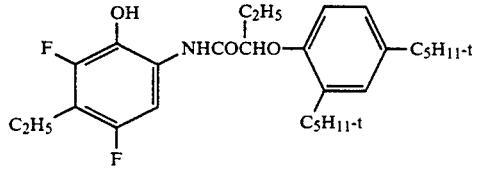
C-8
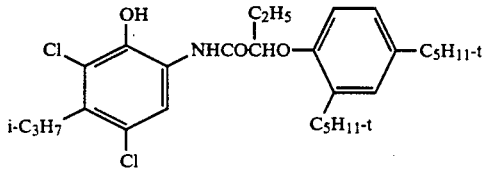
C-9
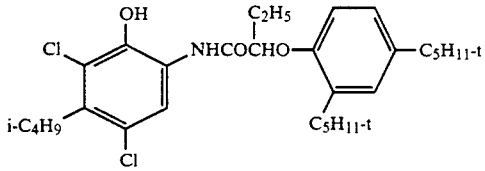
C-10
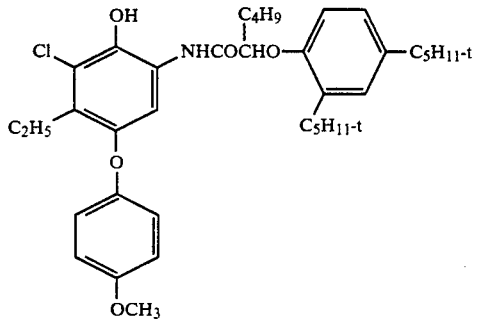
C-11
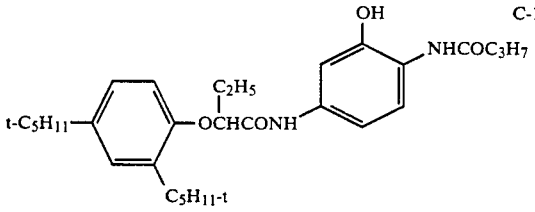
C-12
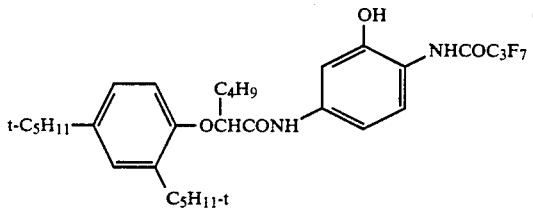
C-13
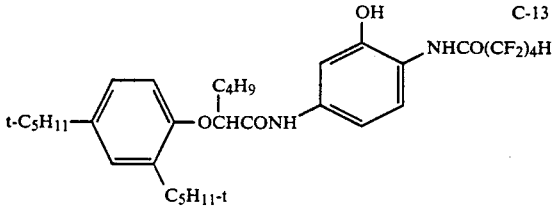
C-14
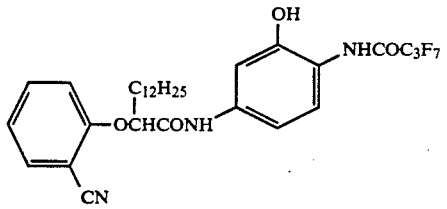
C-15
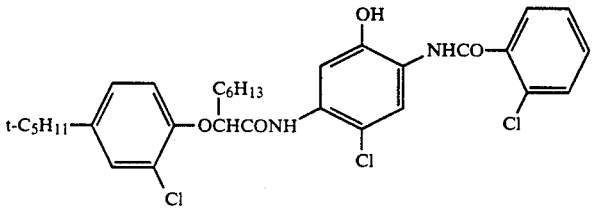

TABLE F-continued
C-16
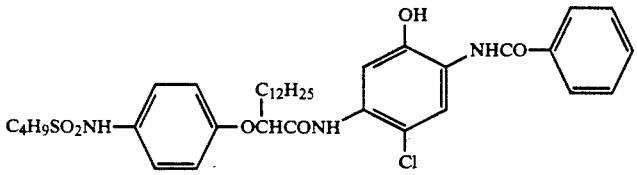
C-17
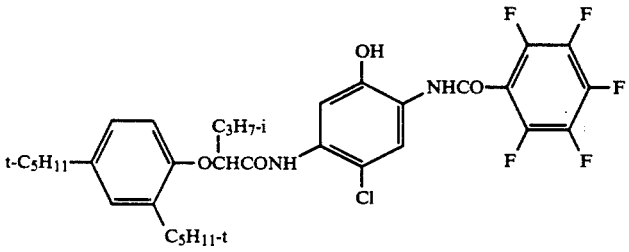
C-18
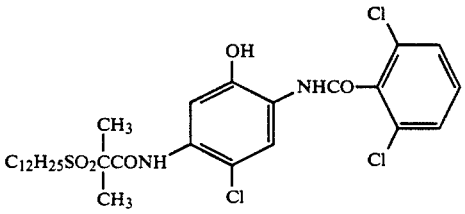
C-19
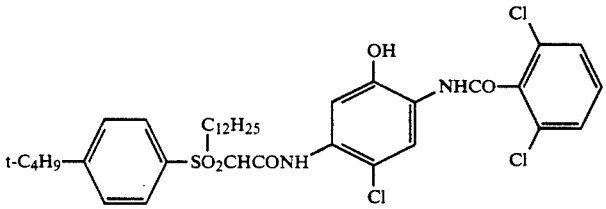
C-20
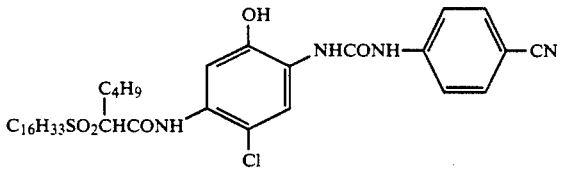
C-21
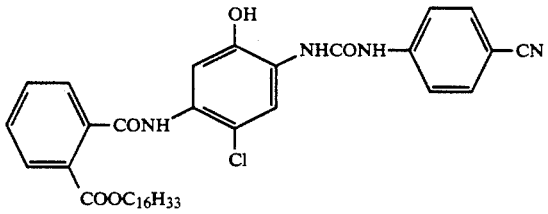
C-22
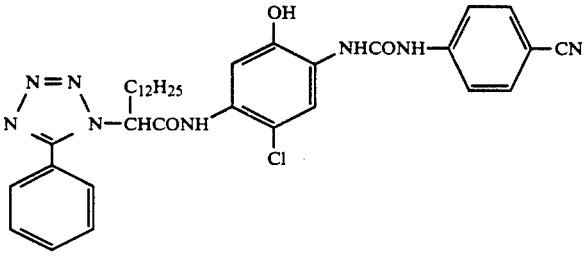

TABLE F-continued
C-23
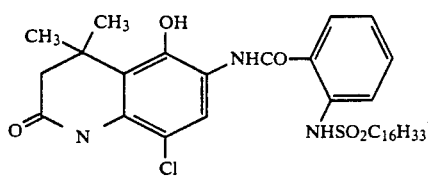
C-24
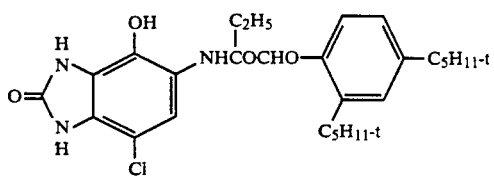
C-25
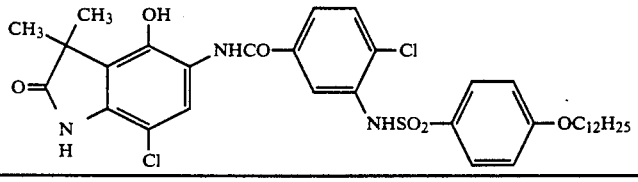
TABLE G
(CC-1)
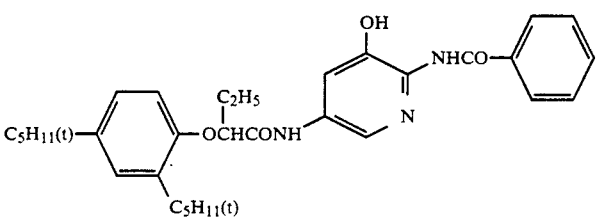
(CC-2)
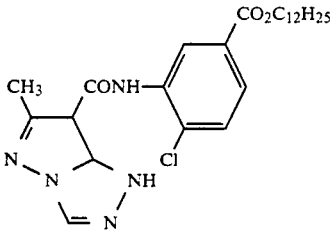
(CC-3)
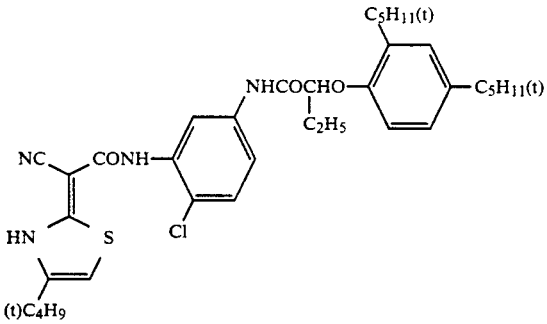
(CC-4)
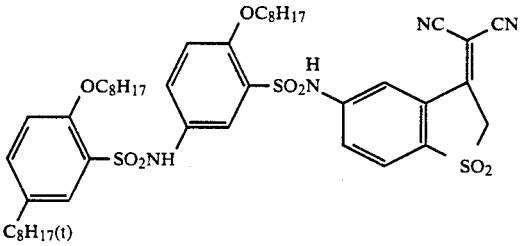

TABLE G-continued
(CC-5)
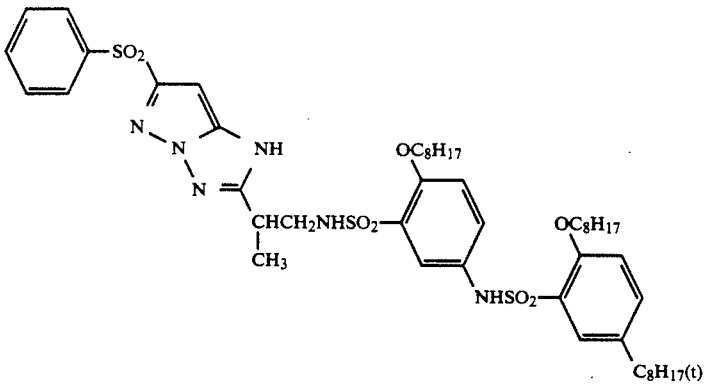
(CC-6)
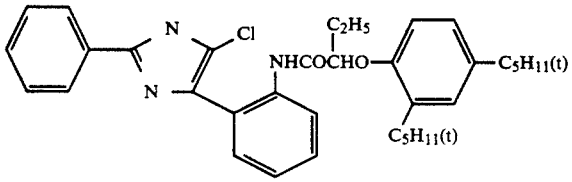
(CC-7)
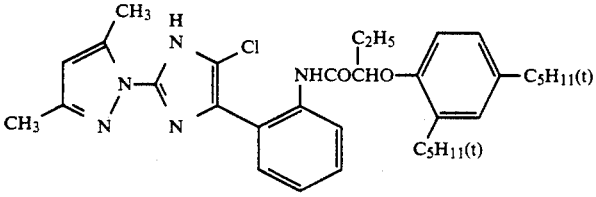
(CC-8)
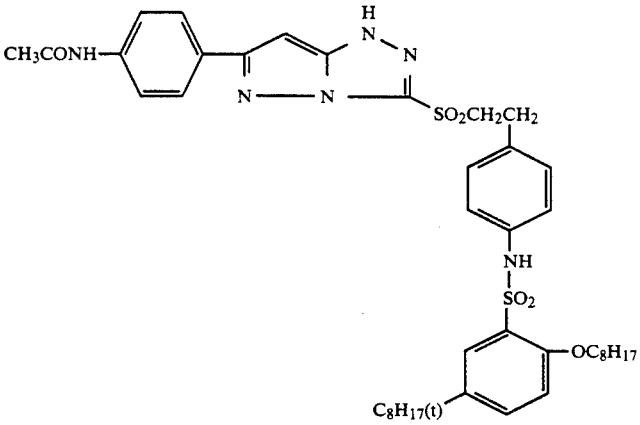
(CC-9)
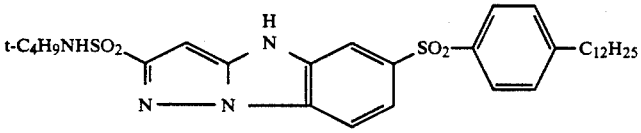
(CC-10)
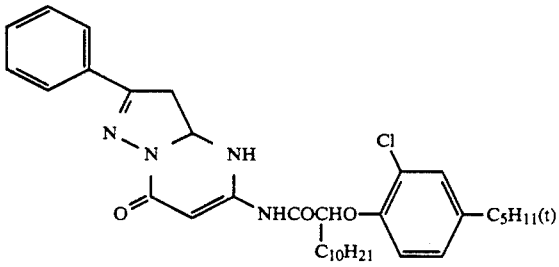

TABLE G-continued
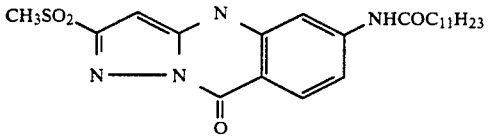
(CC-11)
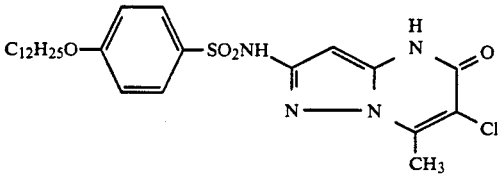
(CC-12)
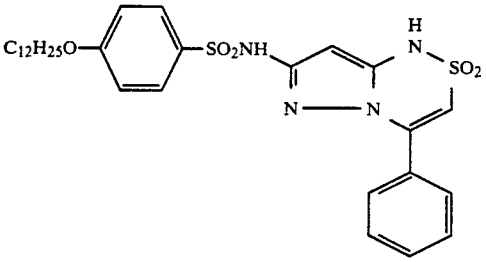
(CC-13)
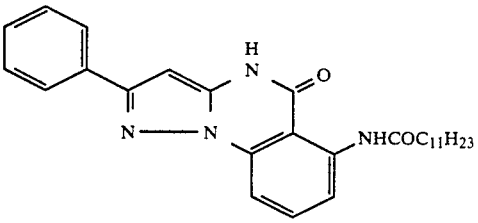
(CC-14)
TABLE H
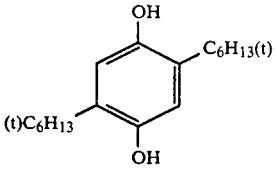
(A-1)
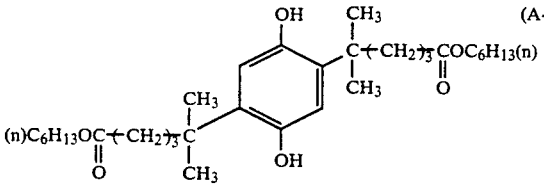
(A-2)
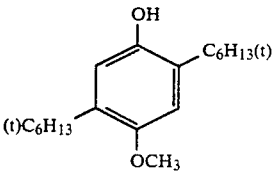
(A-3)
TABLE H-continued
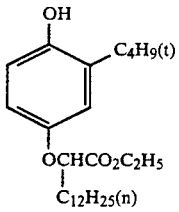
(A-4)
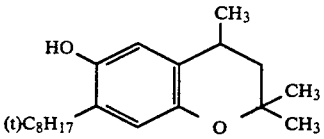
(A-5)
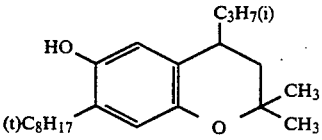
(A-6)
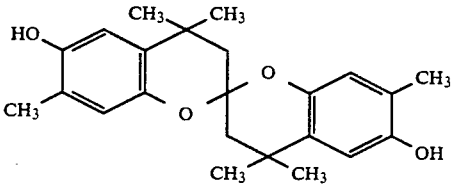
(A-7)

TABLE H-continued
(A-8)
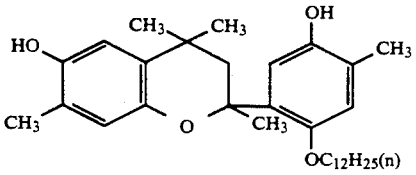
(A-9)
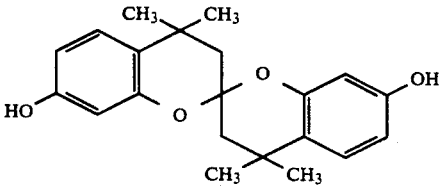
(A-10)
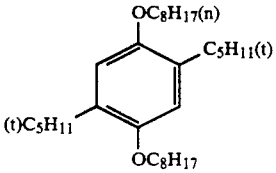
(A-11)
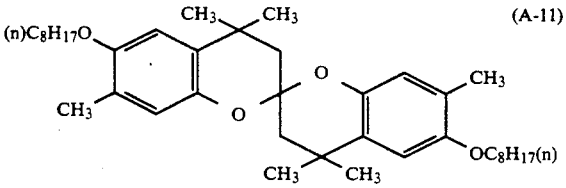
(A-12)
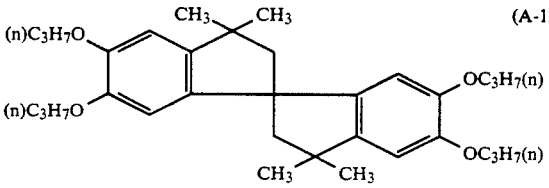
(A-13)
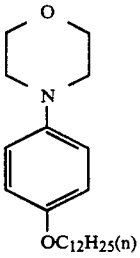
(A-14)
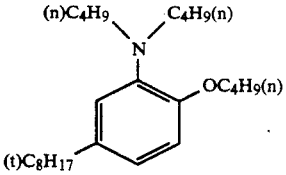
(A-15)
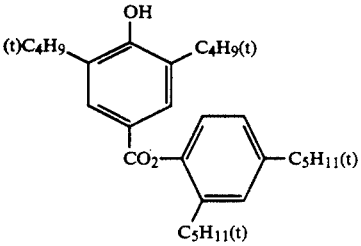
TABLE H-continued
(A-16)
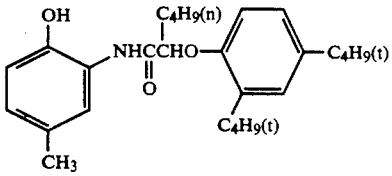
(A-17)
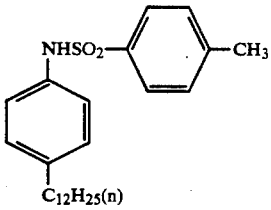
(A-18)
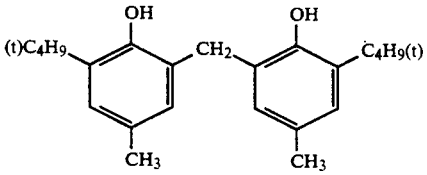
(A-19)
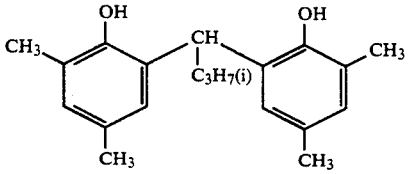
(A-20)
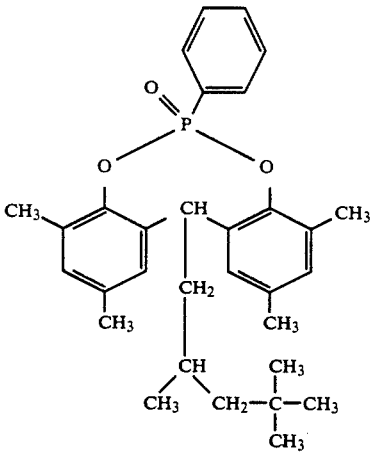
(A-21)
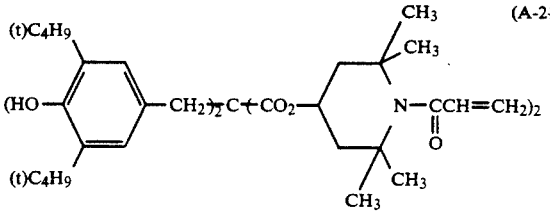

TABLE H-continued
(A-22)
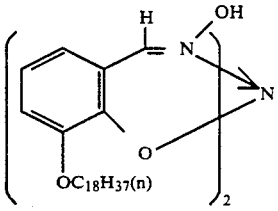
TABLE H-continued
(A-23)
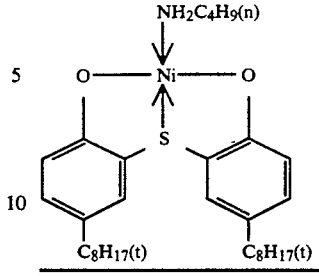
TABLE I
Sensitizing dye A for blue sensitive emulsion layer
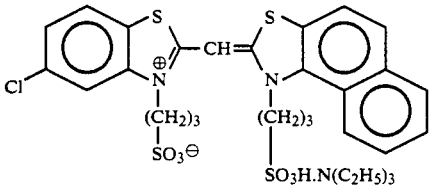
Sensitizing dye B for blue sensitive emulsion layer
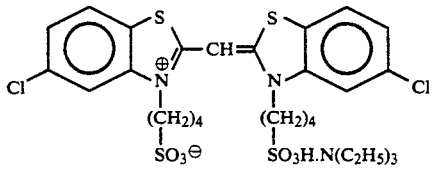
Sensitizing dye C for green sensitive emulsion layer
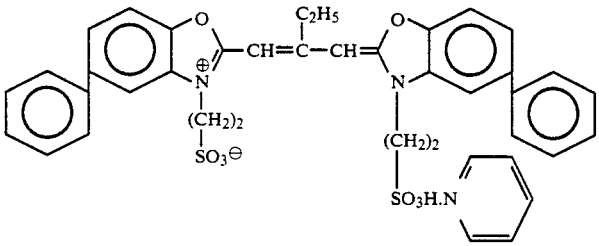
Sensitizing dye D for green sensitive emulsion layer
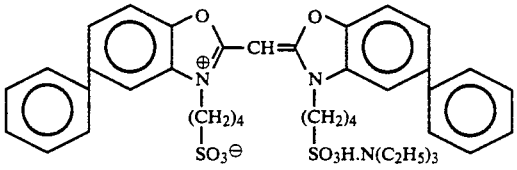
Sensitizing dye E for red sensitive emulsion layer
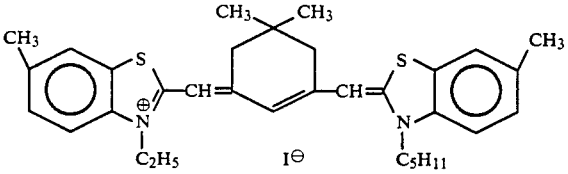
Compound 1
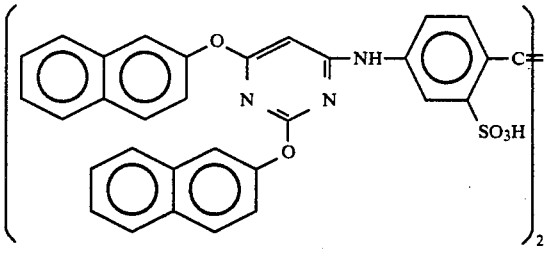
Dye 1
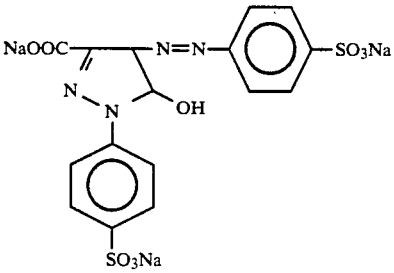
Dye 2
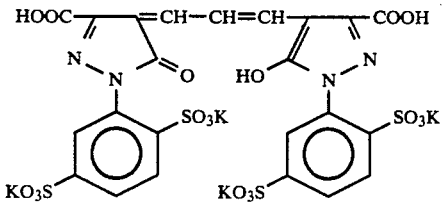
Dye 3

TABLE I-continued
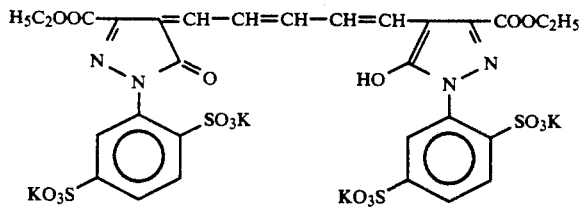
Dye 4
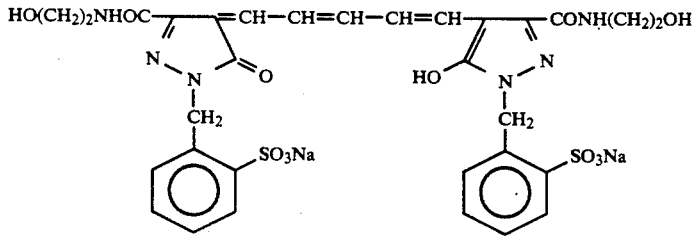
(ExY) Yellow coupler
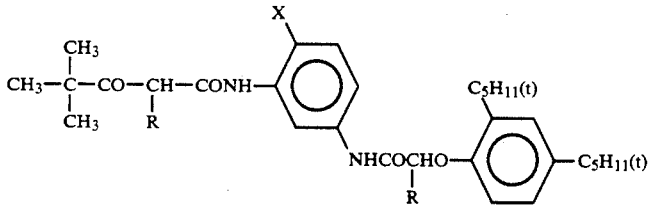
1:1 mixture (mole ratio) of
R = X = Cl and
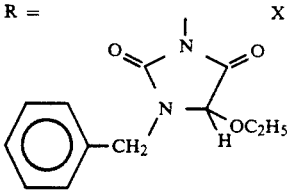
R = X = $OCH_3$
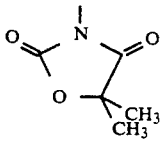
(ExM) mazenta coupler
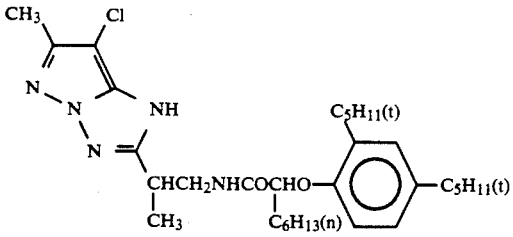
(ExC) cyan coupler
1:1 mixture (mole ratio) of
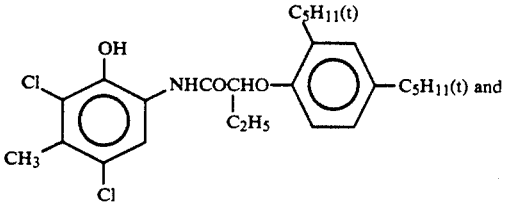
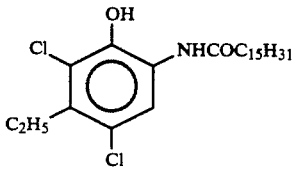
(Cpd-1) dye emage stabilizer
(Cpd-2) dye emage stabilizer TABLE I-continued
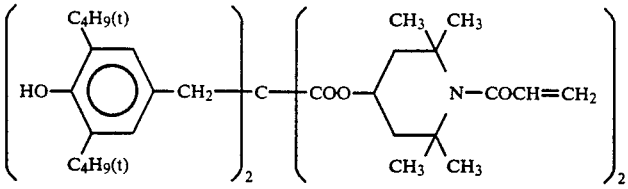
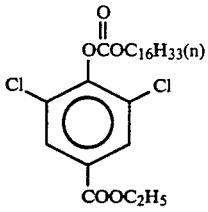
(Cpd-3) dye emage stabilizer
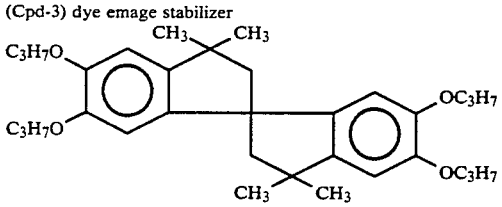
(Cpd-4) dye emage stabilizer
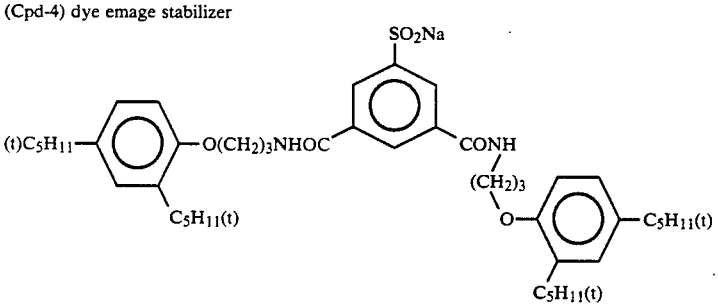
(Cpd-5)
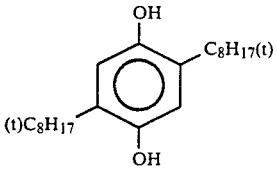
(Cpd-6) dye emage stabilizer
2:4:4 mixture (weight ratio) of
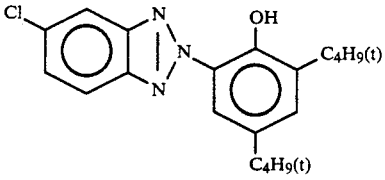
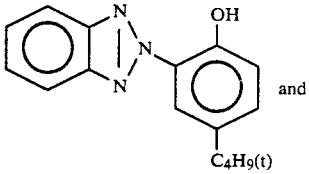
and
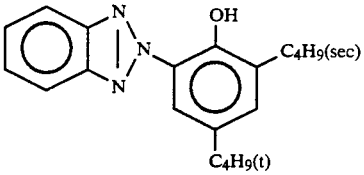
(Cpd-7) dye emage stabilizer
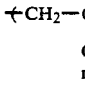
mean molecular weight 60,000
(Cpd-8) dye emage stabilizer
1:1 mixture (weight ratio) of
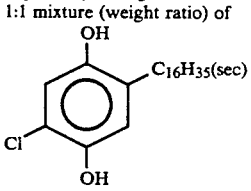
and
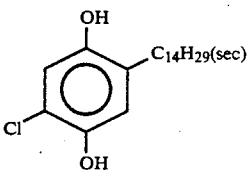
(Cpd-9) dye emage stabilizer
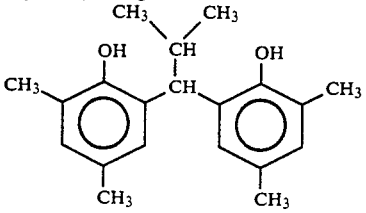
(Cpd-10) antispetic
(Cpd-11) antispetic
(UV-1) vltra violet absorbent TABLE I-continued

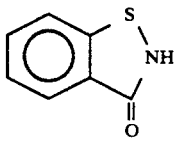

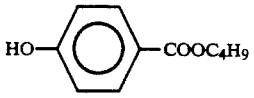

4:2:4 mixture (weight ratio) of

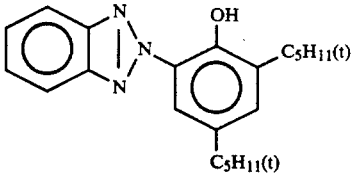

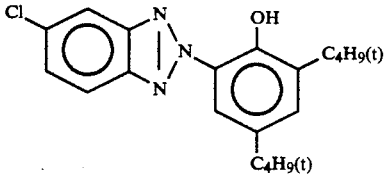

and

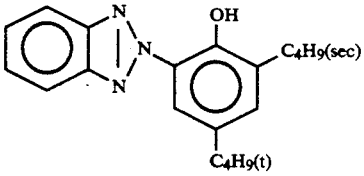

(Solv-1) Solvent

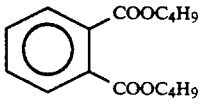

(Solv-2) Solvent
1:1 mixture (volume ratio) of

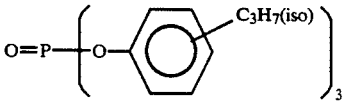

and

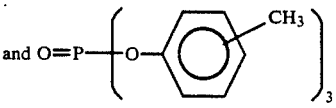

(Solv-3) Solvent
$O{=}P{\leftarrow}O{-}C_9H_{19}(iso))_3$ (Solv-4) Solvent

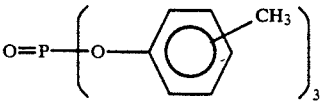

(Solv-5) Solvent

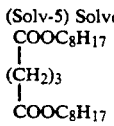

(Solv-6) Solvent
80:20 mixture (volume ratio) of

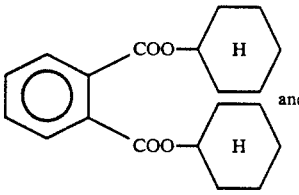

and

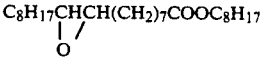

(Solv-7) Solvent

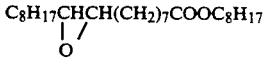

R-1

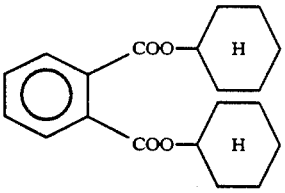

R-2

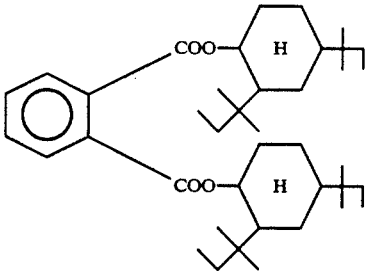

R-3

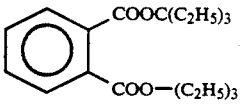

(I)

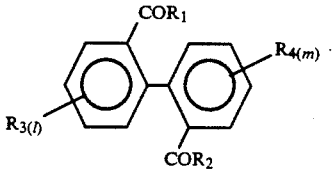

What is claimed is:

1. A silver halide photographically light-sensitive material containing a dispersion in which at least one compound represented by formula (I) and a photographic useful reagent which is hard to dissolve in water, are dispersed together:

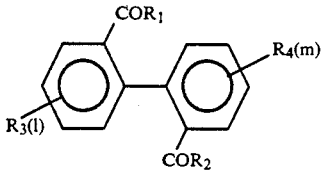

Formula (I)

wherein $R_1$ and $R_2$ independently represent amino having 0 to 32 carbon atoms, alkoxy having 1 to 32 carbon atoms, or aryloxy having 6 to 32 carbon atoms, $R_3$ and $R_4$ independently represent a group which can be substituted on a benzene ring, and l and m independently represent an integer of 0 to 4, $R_3$ and/or $R_4$ being able to be the same or different when l and/or m is 2 to 4.

2. A method of processing the silver halide photographic light-sensitive material according to claim 1, wherein said silver halide photographic light-sensitive material is exposed imagewise and then developed with a color developer not essentially containing benzyl alcohol.

3. The silver halide photographic light-sensitive material according to claim 1, wherein l and m independently represent 0 or 1.

4. The silver halide photographic light-sensitive material according to claim 1, wherein l and m represent 0.

5. The silver halide photographic light-sensitive material according to claim 3, wherein $R_1$ and $R_2$ independently represent a group selected from the group consisting of an amino group having 1 to 24 carbon atoms and an alkoxy group having 1 to 24 carbon atoms.

6. The silver halide photographic light-sensitive material according to claim 3, wherein $R_1$ and $R_2$ independently represent an amino group having an aryl group having 6 to 16 carbon atoms.

7. The silver halide photographic light-sensitive material according to claim 4, wherein $R_1$ and $R_2$ independently represent a group selected from the group consisting of amino group having 1 to 24 carbon atoms and alkoxy group having 1 to 24 carbon atoms.

8. The silver halide photographic light-sensitive material according to claim 4, wherein $R_1$ and $R_2$ independently represent an amino group having an aryl group having 6 to 16 carbon atoms.

9. The silver halide photographically light-sensitive material according to claim 1, wherein the photographic useful reagent is an oil-soluble coupler.

10. The silver halide photographic light-sensitive material according to claim 1, wherein the photographic useful regent is a yellow coupler or a cyan coupler.

11. The silver halide photographic light-sensitive material according to claim 1, wherein an amount in weight of the compound represented by the formula (I) is 0.1 to 1.5 times the photographically useful reagent.

* * * * *